US010651569B2

(12) United States Patent
Watson

(10) Patent No.: US 10,651,569 B2
(45) Date of Patent: May 12, 2020

(54) ANTENNA WITH SELECTIVELY ENABLED INVERTED-F ANTENNA ELEMENTS

(71) Applicant: Paul Robert Watson, Ottawa (CA)

(72) Inventor: Paul Robert Watson, Ottawa (CA)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 0 days.

(21) Appl. No.: 16/041,249

(22) Filed: Jul. 20, 2018

(65) Prior Publication Data

US 2020/0028276 A1 Jan. 23, 2020

(51) Int. Cl.

| | |
|---|---|
| ***H01Q 21/06*** | (2006.01) |
| ***H01Q 1/48*** | (2006.01) |
| ***H01Q 21/00*** | (2006.01) |
| ***H01Q 1/22*** | (2006.01) |

(Continued)

(52) U.S. Cl.

CPC ..... *H01Q 21/065* (2013.01); *H01Q 1/2291* (2013.01); *H01Q 1/48* (2013.01); *H01Q 9/0421* (2013.01); *H01Q 21/0025* (2013.01); *H01Q 5/307* (2015.01)

(58) Field of Classification Search

CPC .... H01Q 21/065; H01Q 21/0025; H01Q 1/48; H01Q 1/2291; H01Q 5/307; H01Q 9/0421

See application file for complete search history.

(56) References Cited

U.S. PATENT DOCUMENTS

| | | | | |
|---|---|---|---|---|
| 2009/0027294 | A1* | 1/2009 | Bourry | H01Q 9/0421 343/848 |
| 2010/0109967 | A1* | 5/2010 | Ranta | H01Q 1/243 343/853 |
| 2014/0104114 | A1 | 4/2014 | Rogers et al. | |

(Continued)

FOREIGN PATENT DOCUMENTS

| | | | |
|---|---|---|---|
| CN | 104901000 | A | 9/2015 |
| CN | 107453034 | A | 12/2017 |
| WO | 2015160450 | A1 | 10/2015 |

OTHER PUBLICATIONS

Watson et al., "Configurable Antenna Array With Diverse Polarizations", U.S. Appl. No. 15/607,595, filed May 29, 2017, 40 pages in total.

(Continued)

*Primary Examiner* — Hoang V Nguyen

(57) ABSTRACT

A radio frequency (RF) antenna unit is described. The RF antenna unit includes a feed portion, at least first and second selective grounding portions each configured to selectively enable or disable an electrical coupling to a substrate, and at least first and second conductive arms. The first conductive arm provides electrical conduction between the feed portion and the first grounding portion, extending from the first grounding portion towards and beyond the feed portion. The second conductive arm provides electrical conduction between the feed portion and the second grounding portion, extending from the second grounding portion towards and beyond the feed portion. First and second inverted F antenna (IFA) elements are defined by the feed portion, the respective first or second grounding portion and the respective first or second conductive arm. The feed portion is common to both the first and second IFA elements.

24 Claims, 19 Drawing Sheets

(51) Int. Cl.
*H01Q 9/04* (2006.01)
*H01Q 5/307* (2015.01)

(56) References Cited

U.S. PATENT DOCUMENTS

| | | | | |
|---|---|---|---|---|
| 2017/0025740 | A1* | 1/2017 | Li | H01Q 1/243 |
| 2017/0033471 | A1* | 2/2017 | Huang | H01Q 21/26 |
| 2018/0175515 | A1 | 6/2018 | Boutayeb et al. | |

OTHER PUBLICATIONS

Y. Li et al., "12-Port 5G Massive MIMO Antenna Array in Sub-6GHz Mobile Handset for LTE Bands 42/43/46 Applications", IEEE Access, vol. 6, Oct. 16, 2017, 11 pages in total.
Data Sheet: RUCKUS ZoneFlex™ R710 Dual-Band 4X4:4 802.11AC Smart Wi-Fi AP, 6 pages in total.

* cited by examiner

ANTENNA WITH SELECTIVELY ENABLED INVERTED-F ANTENNA ELEMENTS

FIELD

The present disclosure relates to antennas. More specifically, the present invention relates to configurable inverted F antenna (IFA) elements and wireless communication devices.

BACKGROUND

Multiple-input multiple-output (MIMO) devices typically benefit from antennas able to optimize the transmission path signal level. However, the direction of the optimal signal path may vary and is often difficult to predict. An antenna which can be configured to have a radiation pattern directed in the optimal or more optimal direction may potentially increase signal level and data rate for wireless communications.

Various antennas may be used in wireless communication devices, including user equipment (UE) devices and access point (AP) devices. Similarly, a number of antennas may be used in wireless local area network (WLAN) devices for providing users with access to services and/or network connectivity. Antennas may also be elements in antenna arrays, which may perform beamforming and beamsteering operations. An antenna may be selected or designed according to various parameters, such as desired antenna polarization and radiation pattern (for example, beam peak and null direction).

In general, a larger number of antennas on a single radio port may be useful for achieving a better transmission path and/or better interference nulling. For smaller or more compact devices, it may be a challenge to implement larger number of antennas, particularly at lower frequencies (e.g., 3.5 GHz). In particular, antenna size typically increases with lower operating frequencies, which limits the number of elements that can be implemented on the device. It is desirable to provide a solution for achieving higher antenna density in devices, while maintaining key performance features such as polarization diversity, high directionality and/or wide frequency bandwidths.

SUMMARY

Disclosed herein is an antenna unit with a plurality of inverted F antenna (IFA) elements. The disclosed antenna unit may achieve a more compact footprint compared to conventional multi-IFA designs. The IFA elements in the disclosed antenna unit can be selectively enabled, and may avoid the need to use a radio frequency (RF) switch for implementation.

In some aspects, the present disclosure describes an RF antenna unit. The RF antenna unit includes a feed portion for electrically coupling the RF antenna unit to an RF signal port. The RF antenna unit also includes at least a first selective grounding portion and a second selective grounding portion, each selective grounding portion being configured to selectively enable or disable an electrical coupling to a substrate. The RF antenna unit also includes a first conductive arm providing electrical conduction between the feed portion and the first selective grounding portion, extending from the first selective grounding portion towards the feed portion and extending beyond the feed portion. The RF antenna unit also includes at least a second conductive arm providing electrical conduction between the feed portion and the second selective grounding portion, extending from the second selective grounding portion towards the feed portion and extending beyond the feed portion. The feed portion, the first selective grounding portion and the first conductive arm together define a first IFA element of the RF antenna unit. The feed portion, the second selective grounding portion and the second conductive arm together define at least a second IFA element of the RF antenna unit. The feed portion is common to both the first and at least the second IFA elements.

In any of the preceding aspects/embodiments, the first conductive arm and the at least second conductive arm may partially overlap with each other, the overlap being a conductive portion of the RF antenna unit that is common to the first and second conductive arms.

In any of the preceding aspects/embodiments, there may be two IFA elements defined by: the feed portion, two respective selective grounding portions and two respective conductive arms; the two IFA elements being arranged with respective conductive arms extending opposite to and partially overlapping with each other.

In any of the preceding aspects/embodiments, there may be four IFA elements defined by: the feed portion, four respective selective grounding portions and four respective conductive arms; the four IFA elements being arranged about the axis of symmetry with a relative rotation of 90° between adjacent IFA elements; and the four IFA elements include first and second pairs of IFA elements, each pair of IFA elements having conductive arms extending opposite to and partially overlapping with each other.

In any of the preceding aspects/embodiments, there may be three IFA elements defined by: the feed portion, three respective selective grounding portions and three respective conductive arms; the three IFA elements being arranged about the axis of symmetry with a relative rotation of 120° between adjacent IFA elements; and the three conductive arms cross each other.

In any of the preceding aspects/embodiments, the first IFA element and the at least second IFA element may be arranged symmetrically relative to each other about an axis of symmetry defined by the feed portion.

In any of the preceding aspects/embodiments, each selective grounding portion may be selectively coupled to a ground plane of the substrate through a switchable element.

In any of the preceding aspects/embodiments, the switchable element may include a PIN diode.

In any of the preceding aspects/embodiments, the switchable element may be configured to receive a control signal to control the switchable element to enable or disable the electrical coupling to the substrate.

In any of the preceding aspects/embodiments, each IFA element may have substantially equal dimensions.

In any of the preceding aspects/embodiments, each IFA element may have substantially same antenna characteristics.

In any of the preceding aspects/embodiments, at least one IFA element may have dimensions different from at least another IFA element, and the feed portion may be common to all IFA elements.

In some aspects, the present disclosure describes an apparatus for wireless communications. The apparatus includes a substrate including a ground plane, an RF signal port, and an RF antenna unit. The RF antenna unit includes a feed portion for electrically coupling the RF antenna unit to the RF signal port, the feed portion defining an axis of symmetry of the RF antenna unit. The RF antenna unit also includes at least a first selective grounding portion and a second selective grounding portion, each selective grounding portion being configured to selectively enable or disable an electrical coupling to the ground plane via the substrate. The RF antenna unit also includes a first conductive arm providing electrical conduction between the feed portion and the first selective grounding portion, extending from the first selective grounding portion towards the feed portion and extending beyond the feed portion. The RF antenna unit also includes at least a second conductive arm providing electrical conduction between the feed portion and the second selective grounding portion, extending from the second selective grounding portion towards the feed portion and extending beyond the feed portion. The feed portion, the first selective grounding portion and the first conductive arm together define a first IFA element of the RF antenna unit. The feed portion, the second selective grounding portion and the second conductive arm together define at least a second IFA element of the RF antenna unit. The feed portion is common to both the first and at least the second IFA elements, the first IFA element and at least the second IFA element being arranged symmetrically relative to each other about the axis of symmetry.

In any of the preceding aspects/embodiments, the first conductive arm and the at least second conductive arm may partially overlap with each other, the overlap being a conductive portion of the RF antenna unit common to the first and second conductive arms.

In any of the preceding aspects/embodiments, the RF antenna unit may have two IFA elements defined by the feed portion, two respective selective grounding portions and two respective conductive arms, the two IFA elements being arranged with respective conductive arms extending opposite to and partially overlapping with each other.

In any of the preceding aspects/embodiments, the RF antenna unit may have four IFA elements defined by the feed portion, four respective selective grounding portions and four respective conductive arms, the four IFA elements being arranged about the axis of symmetry with a relative rotation of 90° between adjacent IFA elements, and the four IFA elements include first and second pairs of IFA elements, each pair of IFA elements having conductive arms extending opposite to and partially overlapping with each other.

In any of the preceding aspects/embodiments, the RF antenna unit may have three IFA elements defined by: the feed portion, three respective selective grounding portions and three respective conductive arms, the three IFA elements being arranged about the axis of symmetry with a relative rotation of 120° between adjacent IFA elements, and the three IFA elements being arranged with the three conductive arms crossing each other.

In any of the preceding aspects/embodiments, at least one IFA element of the RF antenna unit may be defined in a plane of the substrate.

In any of the preceding aspects/embodiments, the feed portion and the selective grounding portions of the RF antenna unit may be substantially perpendicular to the substrate.

In any of the preceding aspects/embodiments, at least one IFA element of the RF antenna unit may be defined in a plane orthogonal to a plane of the substrate.

In any of the preceding aspects/embodiments, each selective grounding portion of the RF antenna unit may be selectively coupled to the ground plane through a switchable element.

In any of the preceding aspects/embodiments, the switchable element may include a PIN diode.

In any of the preceding aspects/embodiments, each conductive arm of the RF antenna unit may have substantially equal length.

In any of the preceding aspects/embodiments, each IFA element of the RF antenna unit may have substantially same antenna characteristics.

Directional references herein such as "front", "rear", "up", "down", "horizontal", "top", "bottom", "side" and the like are used purely for convenience of description and do not limit the scope of the present disclosure. Furthermore, any dimensions provided herein are presented merely by way of an example and unless otherwise specified do not limit the scope of the disclosure. Furthermore, geometric terms such as "straight", "flat", "curved", "point" and the like are not intended to limit the disclosure any specific level of geometric precision, but should instead be understood in the context of the disclosure, taking into account normal manufacturing tolerances, as well as functional requirements as understood by a person skilled in the art.

BRIEF DESCRIPTION OF THE DRAWINGS

Reference will now be made, by way of example, to the accompanying drawings which show example embodiments of the present application, and in which.

Similar reference numerals may have been used in different figures to denote similar components.

DESCRIPTION OF EXAMPLE EMBODIMENTS

In general, in wireless communication devices (particularly multiple-input multiple-output (MIMO) devices) such as user equipment (UE) devices, access point (AP) devices or other wireless local area network (WLAN) devices, a larger number of antennas on a single radio port may be desired in order to achieve a better transmission path and/or better interference nulling. However, space for placing such antennas may be limited. For example, in a UE device, the antennas may be positioned around the periphery of the device. An antenna array may also require a large number of antennas to be placed closely together. Conventionally, such antenna arrays often require a radio frequency (RF) switch to selectively operate each antenna.

Figure 1A:
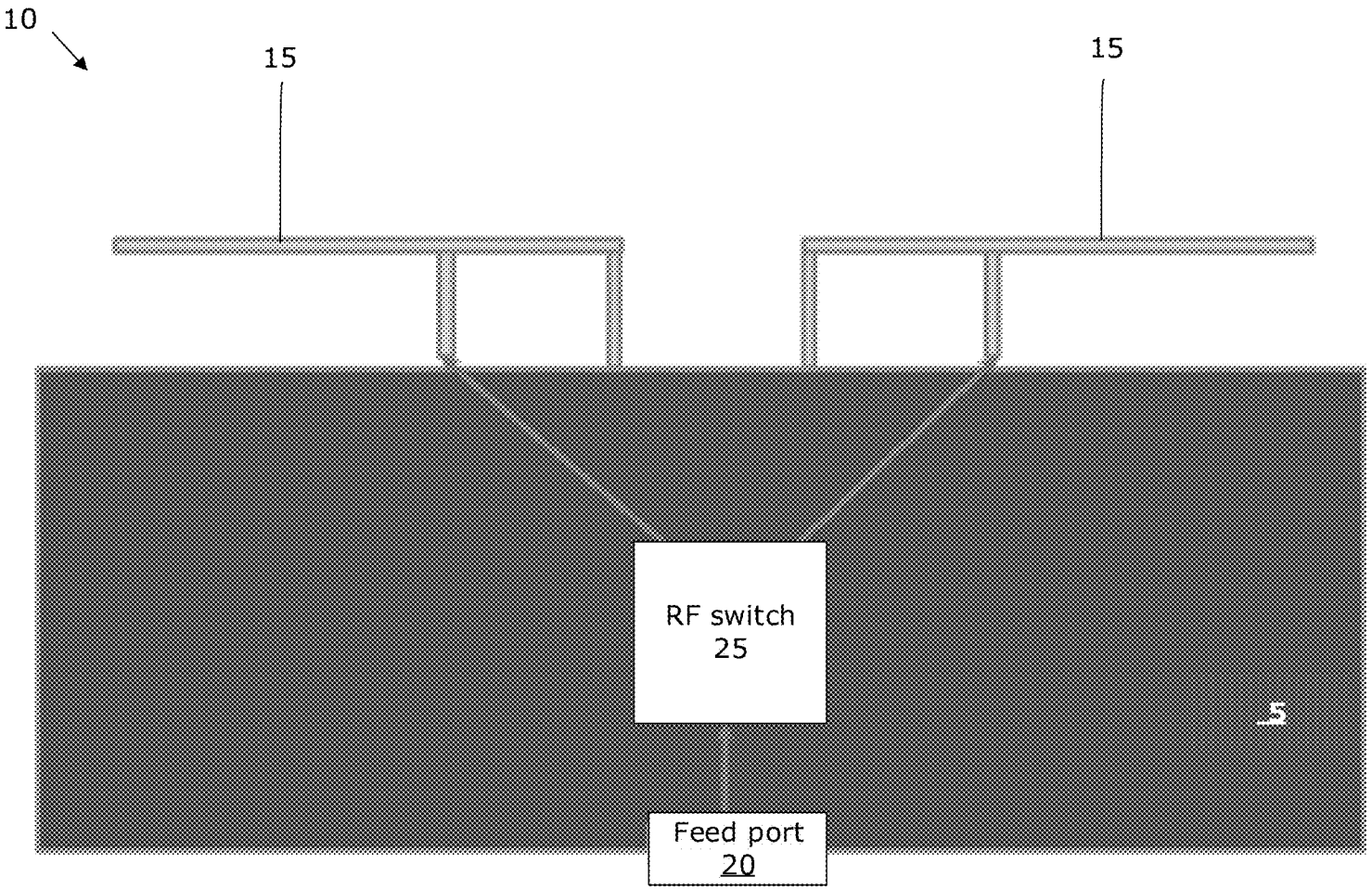
FIG. 1A PRIOR ART
FIG. 1A is a side diagrammatic view of a conventional antenna unit having two inverted-F antenna (IFA) elements.

FIG. 1A illustrates a diagrammatic view of an example conventional antenna unit 10 on a substrate 5, which may further include a ground plane. The antenna unit 10 includes a pair of IFA elements 15 that are separately electrically connected to an RF feed port 20 via an RF switch 25. The antenna unit 10 uses the RF switch 25 to selectively couple the RF feed port 20 to one or both of the IFA antenna elements 15. Conventional antennas such as the one shown in FIG. 1A face challenges in respect of the space required to install and operate these antennas, particularly in more compact devices, as they require the RF switch to operate, which introduces operational complexity, increased equipment cost, increased space requirements, and undesirable transmission loss.

Examples disclosed herein can address one or more of these challenges in at least some applications. In at least some examples, an antenna unit is provided that can operate without the need for a series feed path RF switch. The antenna unit is defined by multiple IFA elements, which may be arranged symmetrically relative to each other about a single RF signal port.

In at least some example embodiments, the antenna unit is configured to operate via single port excitation. Switchable elements, such as PIN diodes, are used for switching the states of the IFA elements to achieve selectively configurable beam patterns. In some examples, the disclosed antenna unit may be controlled to achieve different orthogonal radiation patterns in different switched states. Examples of the disclosed antenna unit may be implemented in the same plane as a ground plane (or grounding substrate) (e.g., for use in UE applications), or normal to the ground plane or grounding substrate (e.g., for use in WLAN AP applications).

Figure 1B:
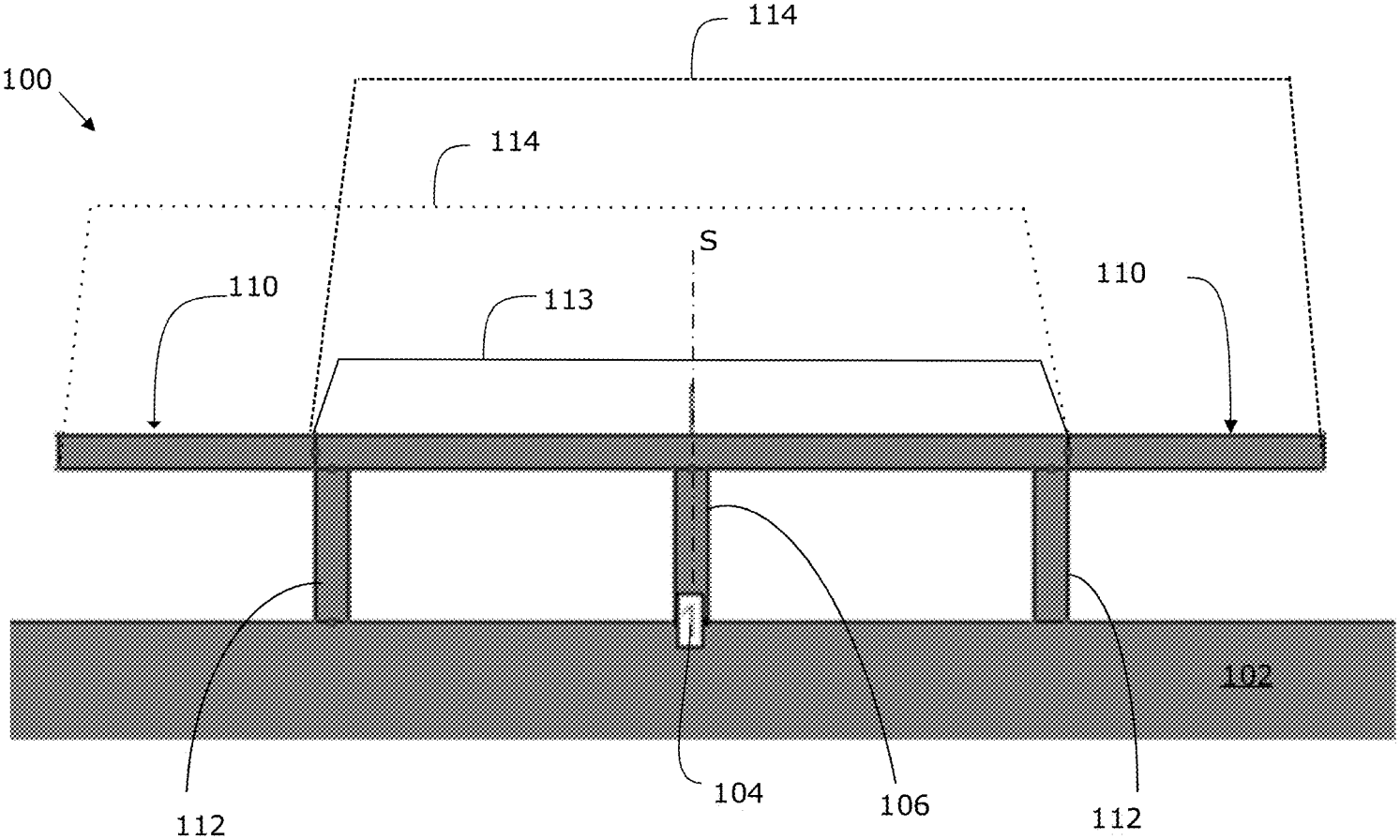
FIG. 1B is a side diagrammatic view of an example antenna unit according to the present disclosure.
Figure 2:
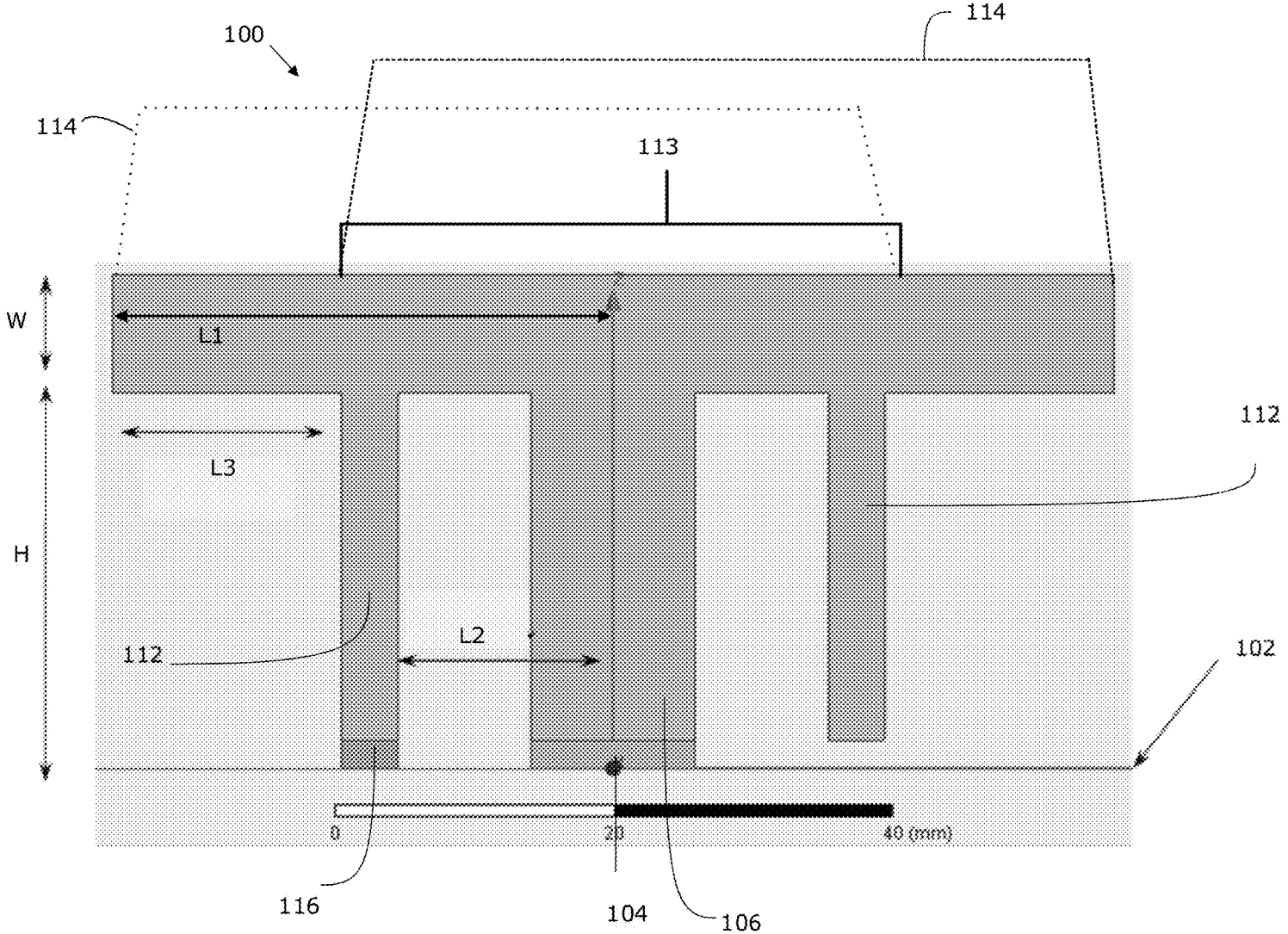
FIG. 2 is a further side diagrammatic view of the example antenna unit of FIG. 1B, showing example dimensions.

FIGS. 1B and 2 illustrate diagrammatic views of an example RF antenna unit 100 in accordance with the present disclosure. The antenna unit 100 is configured to operate at an operating frequency or frequency band. The antenna unit 100 is shown on a substrate 102, which may include a ground plane (not shown) for the antenna unit 100. The antenna unit 100 may be electrically coupled or uncoupled to the ground plane via the substrate 102. The substrate 102 may be supported by a support structure (not shown). In some example embodiments, the antenna unit 100 may be formed from a conductive material printed or otherwise provided on a surface of the substrate 102. A first and at least a second IFA antenna element 110 are defined in the antenna unit 100, as explained further below.

The antenna unit 100 is electrically coupled to a signal port 104 via a feed portion 106. The longitudinal axis of the feed portion 106 defines an axis of symmetry (indicated by dotted line S in FIG. 1B) of the antenna unit 100. The antenna unit 100 includes a plurality of selective grounding portions 112; the example in FIG. 1B shows first and second selective grounding portions 112. Each selective grounding portion 112 is configured so that the selective grounding portion 112 can enable or disable an electrical coupling to the ground plane (not shown) by enabling or disabling electrical coupling to the substrate 102. For example, FIG. 2 shows a switchable element 116 (e.g., a switchable PIN diode) at the end of the selective grounding portion 112, to selectively enable or disable an electrical coupling, for example to the ground plane, via the substrate 102. In some example embodiments, the switchable element 116 may be a tunable element which can be variably tuned. For example, in some embodiments, the switchable element may be tuned to function as an electrical short or a non-zero impedance, or may include a tuning or varactor diode.

The antenna unit 100 also includes a plurality of conductive arms 114; the example in FIG. 1B shows first and second conductive arms 114. The number of conductive arms 114 corresponds to the number of selective grounding portions 112. Each conductive arm 114 provides electrical conduction between the feed portion 106 and a respective one selective grounding portion 112, and extends from the respective one selective grounding portion 112 towards the feed portion 106 and beyond the feed portion 106. It should be noted that the conductive arms 114 may not be distinct from each other. For example, the conductive arms 114 may overlap with each other, such that the conductive arms 114 have an overlapping common portion 113. Such a configuration will be discussed in detail further below.

In the example shown, the conductive arms 114 may be formed integrally with the feed portion 106 and the selective grounding portions 112. Thus, although described as different portions of the antenna unit 100, the feed portion 106, selective grounding portions 112 and conductive arms 114 may not be distinct or physically separate portions of the antenna unit. Conceptually, the antenna unit 100 shown in FIG. 1B may also be thought of as having one arm that provides electrical conduction between the feed portion 106 and both selective grounding portions 112, and extending from both selective grounding portions 112. For ease of understanding, the present disclosure will refer to the antenna unit 100 as having a plurality of conductive arms 114 with respective lengths as indicated, and with each conductively arm 114 corresponding to a respective plurality of selective grounding portions 112.

Figure 3:
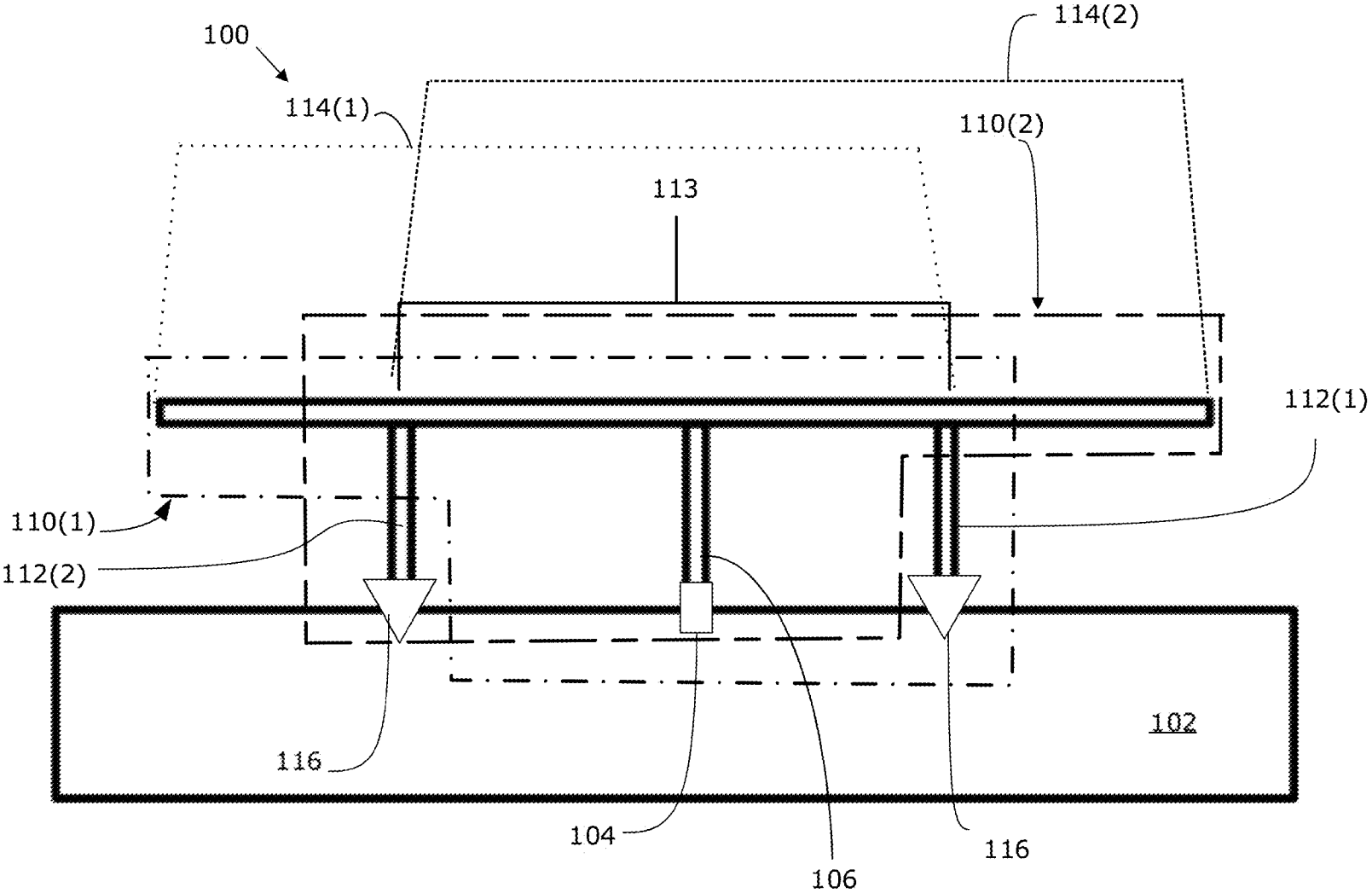
FIG. 3 is a side diagrammatic view of another example antenna unit according to the present disclosure.

The feed portion 106, together with one conductive arm 114, and the respective selective grounding portion 112, define one IFA element 110 of the antenna unit 100. As noted above, the conductive arm 114 of the IFA element 110 is considered to be the conductive portion of the antenna unit 100 that extends from the grounding portion 112 of that IFA element 110 towards the feed portion 106 and extending beyond the feed portion 106, explained further below. The feed portion 106 is common to all IFA elements 110, such that the IFA elements 110 are not discrete elements of the antenna unit 100. For example, as shown in FIG. 3, the feed portion 106, first selective grounding portion 112(1), and first conductive arm 114(1), together define a first IFA element 110(1); the feed portion 106, second selective grounding portion 112(2), and second conductive arm 114

(2), together define a second IFA element 110(2). The elements included in IFA elements 110(1) and 110(2) are conceptually indicated by respective dashed boxes. Thus, as can be seen in FIG. 3, the first IFA element 110(1) and second IFA element 110(2) include respective first and second conductive arms 114(1), 114(2) that extend from the corresponding first and second selective grounding portions 112(1), 112(2) towards and extending beyond the common feed portion 106. As shown in FIG. 3, the conductive arms 114(1) and 114(2) may overlap at least partially over a common portion 113 of their length. In some embodiments, common portion 113 can be an integral conductive portion of the RF antenna unit 100 that is common to the first and second conductive arms 114(1) and 114(2). Thus, conceptually, IFA elements 110(1) and 110(2) can be seen to overlap at least partially, in addition to sharing the common feed portion 106.

Notably, in some embodiments the feed portion 106, and the common portion 113, are common to both the first IFA element 110(1) and the second IFA element 110(2). Thus, although the antenna unit 100 is considered to define first and second IFA elements 110(1), 110(2), the first and second IFA elements 110(1), 110(2) are not discrete elements of the antenna unit 100. It should be noted that, in some embodiment, there may not be an overlapping common portion 113 (e.g., the conductive arms 114(1), 114(2) may not be collinear and hence may not overlap), however the feed portion 106 remains common to the first and second IFA elements 110(1), 110(2) in all embodiments.

Figure 8:
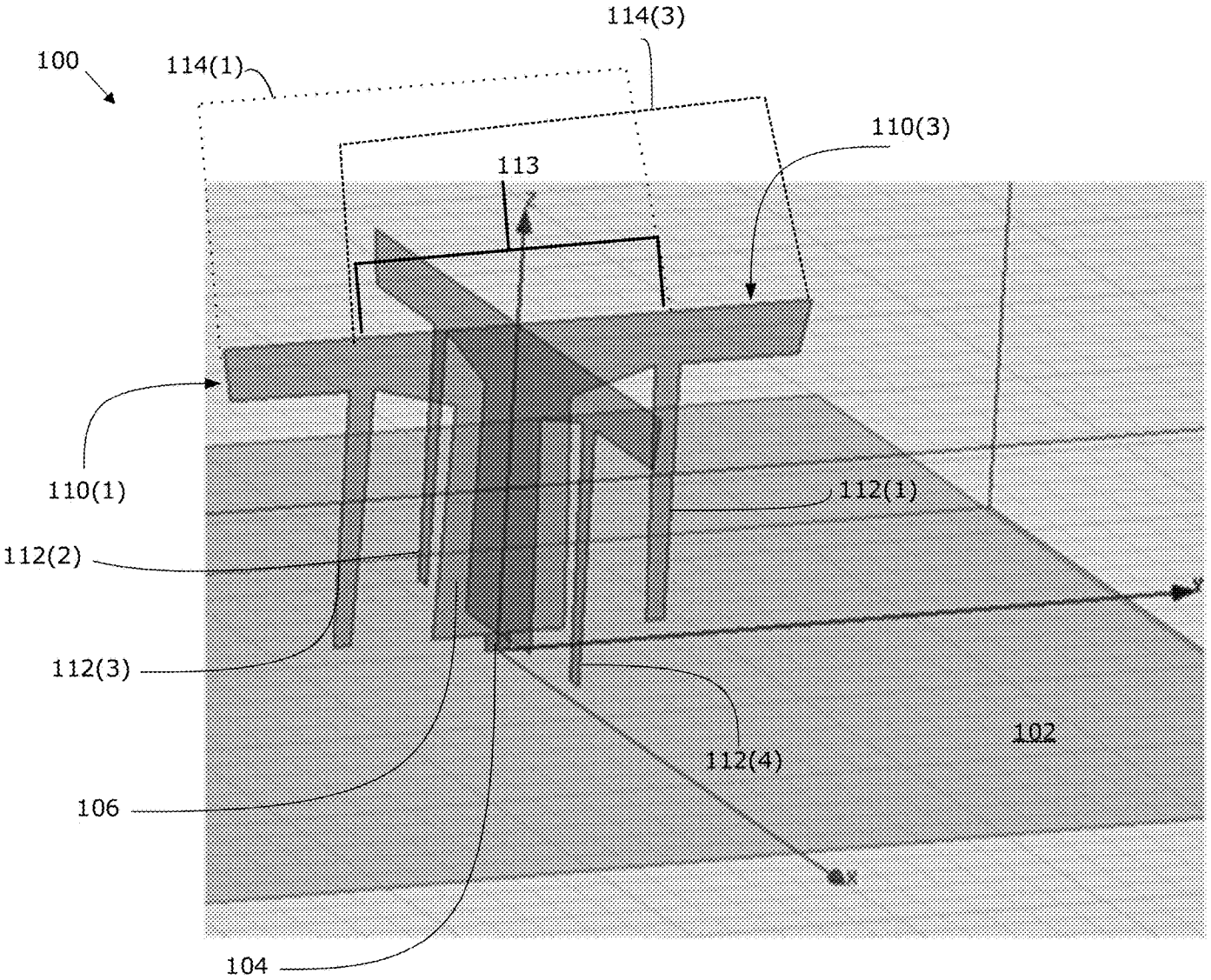
FIG. 8. is a diagrammatic perspective view of another example antenna unit, having four IFA elements, according to the present disclosure.

In some example embodiments, the antenna unit 100 has two IFA elements 110, for example as shown in the examples of FIGS. 1B-5. In other examples, the antenna unit 100 has more than two IFA elements 110, for example having four IFA elements 110, as shown in the example of FIG. 8, discussed further below. Other numbers of IFA elements 110 may be defined in the antenna unit 100. Regardless of number, the IFA elements 110 may be arranged symmetrically about the axis of symmetry defined by the feed portion 106. Such an arrangement may be useful in order to achieve a more symmetric radiation pattern for the antenna unit 100. In the case where the antenna unit 100 has two IFA elements 110, the two IFA elements 110 may be arranged with respective conductive arms 114 extending away from and opposite to each other. In example embodiments, the IFA elements 110 may be arranged asymmetrically about the axis defined by the feed portion 106. For example, in the case where the antenna unit 100 has two IFA elements 110, IFA elements 110 may be arranged in a rotation angle other than 180° relative to each other. For example, the IFA elements 110 may be arranged at 90° relative to each other. In the case where the antenna unit 100 has four IFA elements 110, the four IFA elements 110 may be arranged with a separation of 90° between adjacent IFA elements 110, if arranged symmetrically; or at some other angle of separation, if asymmetrically.

Each selective grounding portion 112 may be selectively coupled to the substrate 102 via a respective switchable element 116. Generally, the switchable element 116 may be any suitable element that can selectively enable or disable an electrical coupling with the substrate 102, for example by creating a virtual, RF open circuit or closed circuit. As shown in the example of FIG. 3, the switchable element 116 may be a DC switching PIN diode or other PIN diodes known in the art. The PIN diode can be biased either on or off (e.g., via a control signal from a processor of a wireless communication device in which the antenna unit 100 is implemented) to selectively enable or disable the electrical coupling to the substrate 102. In some examples, the switchable element 116 may selectively enable or disable an electrical coupling by creating a physical open circuit or closed circuit, such as with the use of microelectromechanical system (MEMS) devices.

Figure 4A:
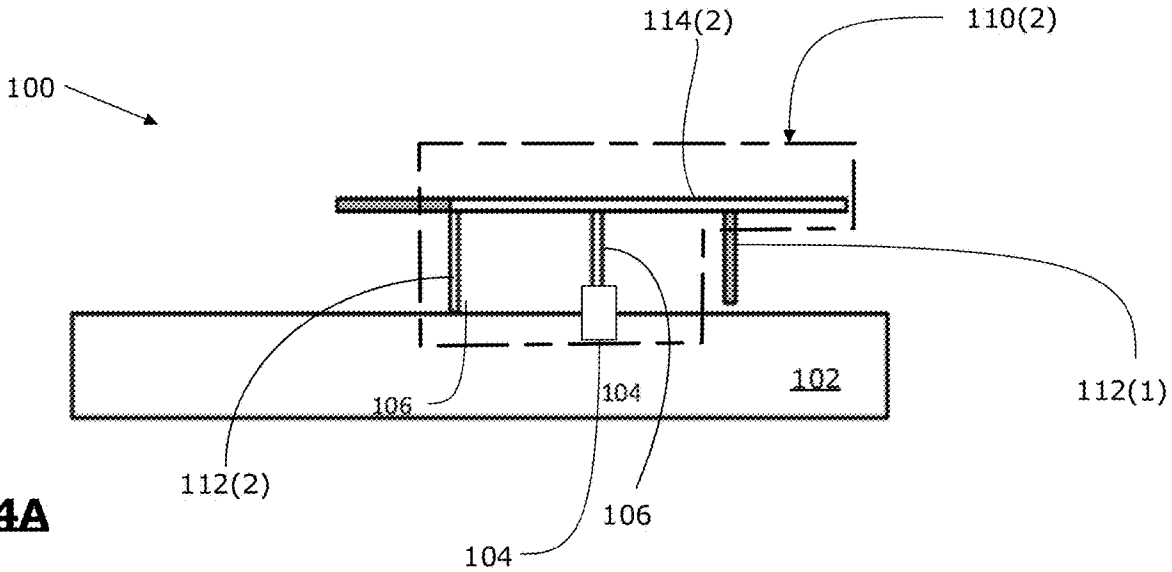
FIG. 4A is a further side diagrammatic view of the example antenna unit of FIG. 1B and illustrates how the example antenna unit of FIG. 1B may be conceptually understood as being formed from multiple superimposed IFA elements.
Figure 4B:
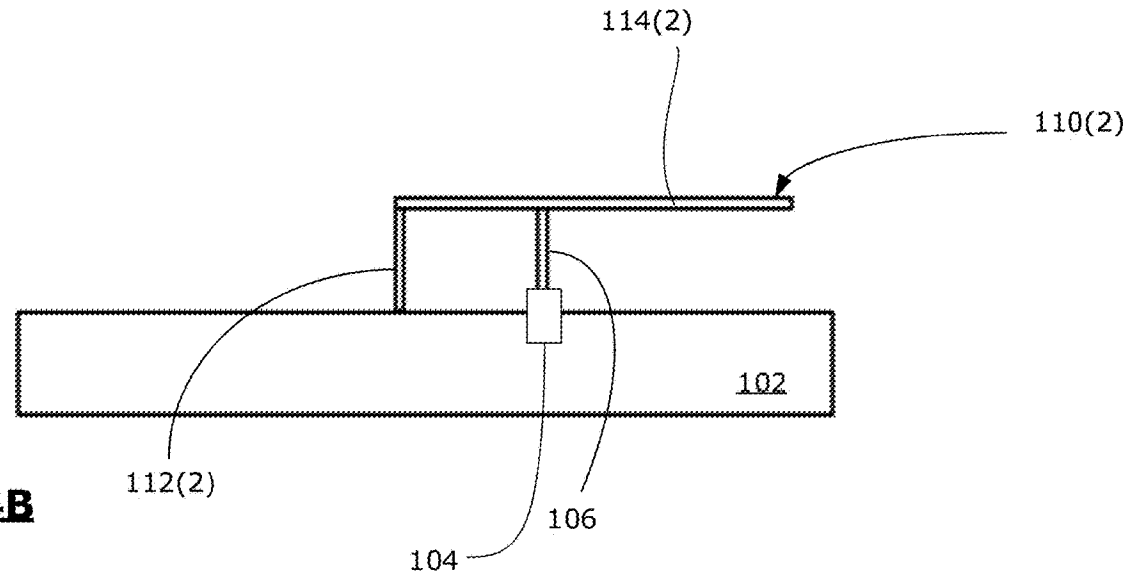
FIG. 4B is a side diagrammatic view of an antenna element of the antenna unit FIG. 1A which may conceptually be used to form the example antenna unit of FIG. 1B.

Thus, conceptually as shown in FIGS. 4A and 4B, the antenna unit 100 is formed by superimposing and mirroring a plurality of IFA elements 110 about a single RF signal port 104 of the antenna unit 100, with each IFA element 110 being independently controllable to be connected to ground or not by controlling the switchable elements 116. The overlapping nature of the IFA elements 110 results in a more compact design for the antenna unit 100, which may save space and allow more antennas or other components to be installed. Further, no RF switching component is required.

An IFA element 110 whose grounding portion 112 is not electrically coupled to the substrate 102 (e.g., whose PIN diode is biased off) may be considered to be inactive and may have reduced or negligible contribution to the overall radiation pattern of the antenna unit 100. Portions of an inactive IFA element 110 may be considered parasitic elements for an active IFA element.

This is conceptually illustrated in FIGS. 4A and 4B. For simplicity, the switchable elements 116 are not shown in FIGS. 4A and 4B. FIG. 4A shows an antenna unit 100 substantially identical to that shown in FIG. 1B that includes IFA elements 110(1) and 110(2) superimposed and symmetrically located around the feed portion 106. FIG. 4A shows that the electrical coupling between the second selective grounding portion 112(2) and the substrate 102 is enabled, and the electrical coupling between the first selective grounding portion 112(1) and the substrate 102 is disabled. As a result, only the second IFA element 110(2) is active. The second IFA element 110(2) has parasitic artifacts due to portions of inactive IFA element 110(1). The first selective ground portion 112(1) and an extending portion of the first conductive arm 114(1) (both indicated as dark-colored portions) are high impedance open stubs. Specifically, the first selective ground portion 112(1), when not coupled to the ground plane, presents a relatively high impedance parasitic stub to the conductive arm 114(2) of the second IFA element 110(2). Similarly, the first conductive arm 114(1) is shorted by the connection to ground at the second selective grounding portion 112(2), so the extended portion of the first conductive arm 114(1) is an open circuit stub that presents a relatively high impedance parasitic stub to the grounding portion 112(2) of the second IFA element 110(2). The active second IFA element 110(2) is defined by the second conductive arm 114(2), whose length extends from the second selective grounding portion 112(2) towards and beyond the feed portion 106. The active IFA element 110(2), is conceptually illustrated in FIG. 4B (with parasitic elements removed for ease of understanding). It should be noted that the IFA element 110(2) shown in FIG. 4B is substantially identical to a conventional IFA element such as IFA element 15 seen in FIG. 1A. Thus, conceptually, the antenna unit 100 shown in FIG. 4A could be formed from multiple superimposed IFA elements 110.

In the example shown in FIG. 4A, the antenna unit 100 may have different switched states, defined by different grounding portions 112 being electrically coupled or not electrically coupled to the grounding plane (via coupling to the substrate 102), with different radiation patterns being achievable using different switched states, as illustrated in further examples below. In this way, the radiation pattern of the antenna unit 100 can be configurable.

Some example dimensions of the antenna unit 100 are now described with reference to FIG. 2. Generally, the antenna unit 100 may be designed with specific dimensions in order to emit or receive wireless RF signals within a desired operating frequency or frequency band. For example, the antenna unit 100 may have at least one IFA element 110 with an operating frequency of 2.4 GHz, or an operating frequency of 5.5 GHz, or any operating frequency within the range of about 100 MHz to 20 GHz or higher, for example about 2.4 GHz to about 5.5 GHz. In some examples, IFA elements 110 designed to operate at different operating frequencies may be used in a singled antenna unit 100 (e.g., in an antenna unit 100 with an asymmetrical configuration). In example embodiments, different antenna units 100 with IFA elements 110 operating at different frequencies may be used together within a single communication device.

In the example of FIG. 2, each IFA element 110 has substantially the same dimensions, and substantially the same operating frequency (e.g., 5 GHz) and antenna characteristics. In this example, the IFA elements 110 are each formed of substantially rectilinear lengths. Each conductive arm 114 may have substantially equal length L1 (e.g., about 0.65 times the operating wavelength λ), substantially equal width W (e.g., about 0.16λ) and at substantially equal spacing H (e.g., about 0.5λ) from the substrate 102. The grounding portions 112 may all be located a distance L2 (e.g., about 0.11λ) from the central axis of symmetry, and the conductive arms 114 may each extend a distance L3 (e.g., about 0.3λ) from each respective grounding portion 112. In the present disclosure, "substantially equal" and "about" can include a range within normal manufacturing tolerances, for example +/−5%. In other example embodiments, the IFA elements 110 may have different dimensions (e.g., having grounding portions 112 at different spacing from the axis of symmetry) and/or have different operating characteristics.

In some example embodiments, the antenna unit 100 may be made from a conductive material such as copper, a copper alloy, aluminum or an aluminum alloy. The antenna unit 100 may be formed as one integral piece.

In some example embodiments, the substrate 102 may be a reflector element, such as for example, a multi-layer printed circuit board (PCB) that can also include a conductive ground plane layer with a ground connection, one or more dielectric layers, and one or more layers of conductive traces for distributing control and power signals throughout the substrate. By way of non-limiting example, in one possible configuration the reflector element is a 200 mm by 200 mm square, although other shapes and sizes are possible.

In at least some example embodiments, the PCBs may be 0.5 mm thick, although thicker and thinner substrates could be used. Conventional PCB materials such as those available under the Taconic™ or Arlon™ brands can be used. In some examples, the PCBs may be formed from a thin film substrate having a thickness thinner than around 600 μm in some examples, or thinner than around 500 μm, although thicker substrate structures are possible. Typical thin film substrate materials may be flexible printed circuit board materials such as polyimide foils, polyethylene naphthalate (PEN) foils, polyethylene foils, polyethylene terephthalate (PET) foils, and liquid crystal polymer (LCP) foils. Further substrate materials include polytetrafluoroethylene (PTFE) and other fluorinated polymers, such as perfluoroalkoxy (PFA) and fluorinated ethylene propylene (FEP), Cytop® (amorphous fluorocarbon polymer), and HyRelex materials available from Taconic. In some embodiments the substrates are a multi-dielectric layer substrate.

Figure 5:
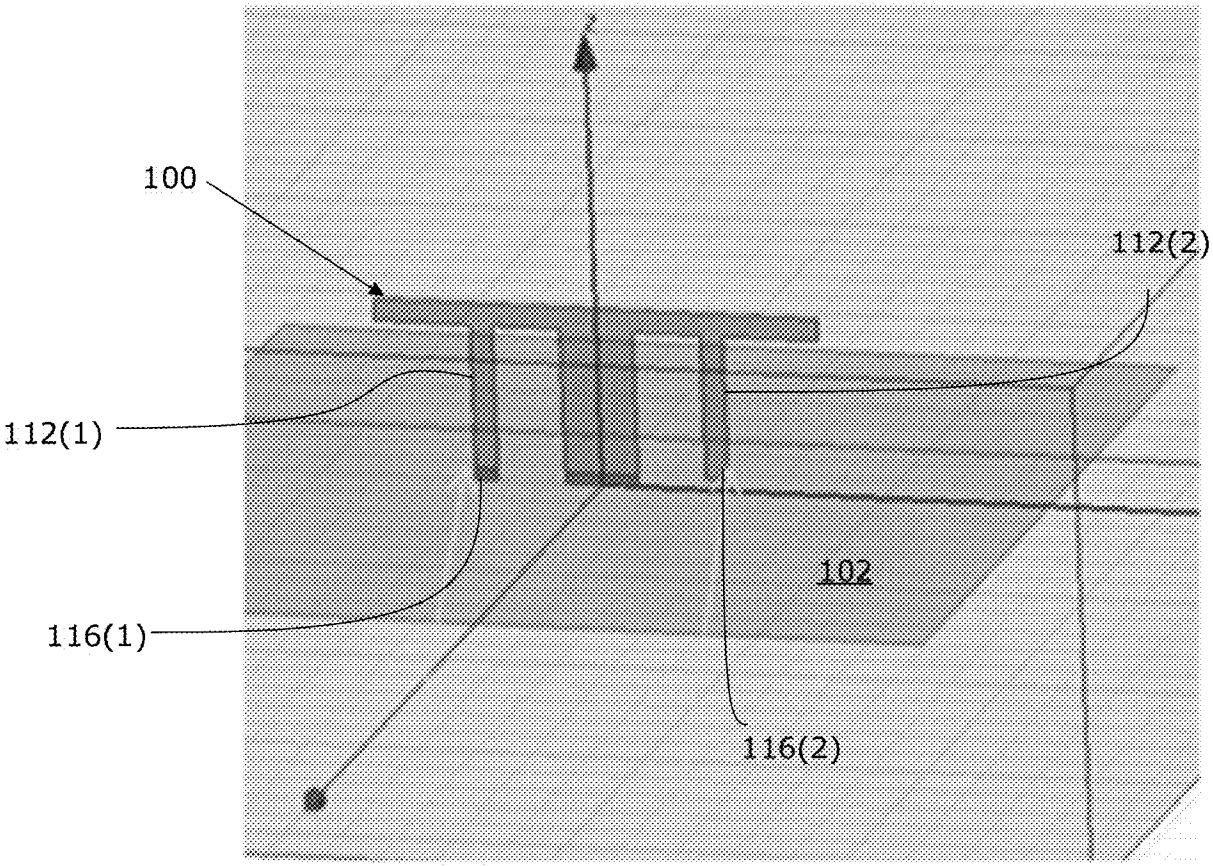
FIG. 5 is a diagrammatic perspective view of another example antenna unit according to the present disclosure.

In some example embodiments, at least one IFA element 110 of the antenna unit 100 may be located in a common plane with the substrate 102. For example, the antenna unit 100 may be substantially planar and may be printed on the substrate 102. In other examples, at least one IFA element 110 of the antenna unit 100 may be in a plane orthogonal to the plane of the substrate 102. For example, as shown in FIG. 5, the antenna unit 100 may be entirely orthogonal to the plane of the substrate 102.

In at least some example embodiments, the antenna unit 100 provides independently configurable radiation patterns via selective grounding of different IFA elements 110. In this way, the antenna unit 100 may be configurable to emit or receive RF signals with directional or non-directional radiation patterns. In the present disclosure, a directional radiation pattern is one in which the radiation pattern is significantly stronger towards one direction, compared to at least one other direction. The directionality of a radiation pattern may be determined by the direction and strength of a main lobe of the radiation pattern, with side lobes of the radiation pattern being significantly smaller than the main lobe. A non-directional radiation pattern may also be referred to as an omni-direction radiation pattern. The disclosed antenna unit 100 may be controlled to operate as a directional or non-directional antenna.

Selectively enabling or disabling grounding of the different grounding portions 112 may be performed via control signals from an antenna controller (not shown). The antenna controller could for example be a processing unit of the wireless communication device, or be part of the antenna unit 100 itself. The antenna controller may execute instructions to selectively control the switchable elements 116 of the antenna unit 100.

The symmetrical configuration of the antenna unit 100 (with IFA elements 110 being defined symmetrically about the symmetrical axis of the antenna unit 100), may help to achieve symmetrical radiation patterns. In some applications, symmetrical radiation patterns may be desired or preferred. However, it will be understood that the IFA elements 110 may not necessarily be symmetrically mirrored around the central axis defined by the feed portion 106, such as where a symmetrical radiation pattern is not desired or is not necessary. For example, spacing between adjacent IFA elements 110 may not be equal and/or dimensions of IFA elements 110 may not be the same.

Figure 6:
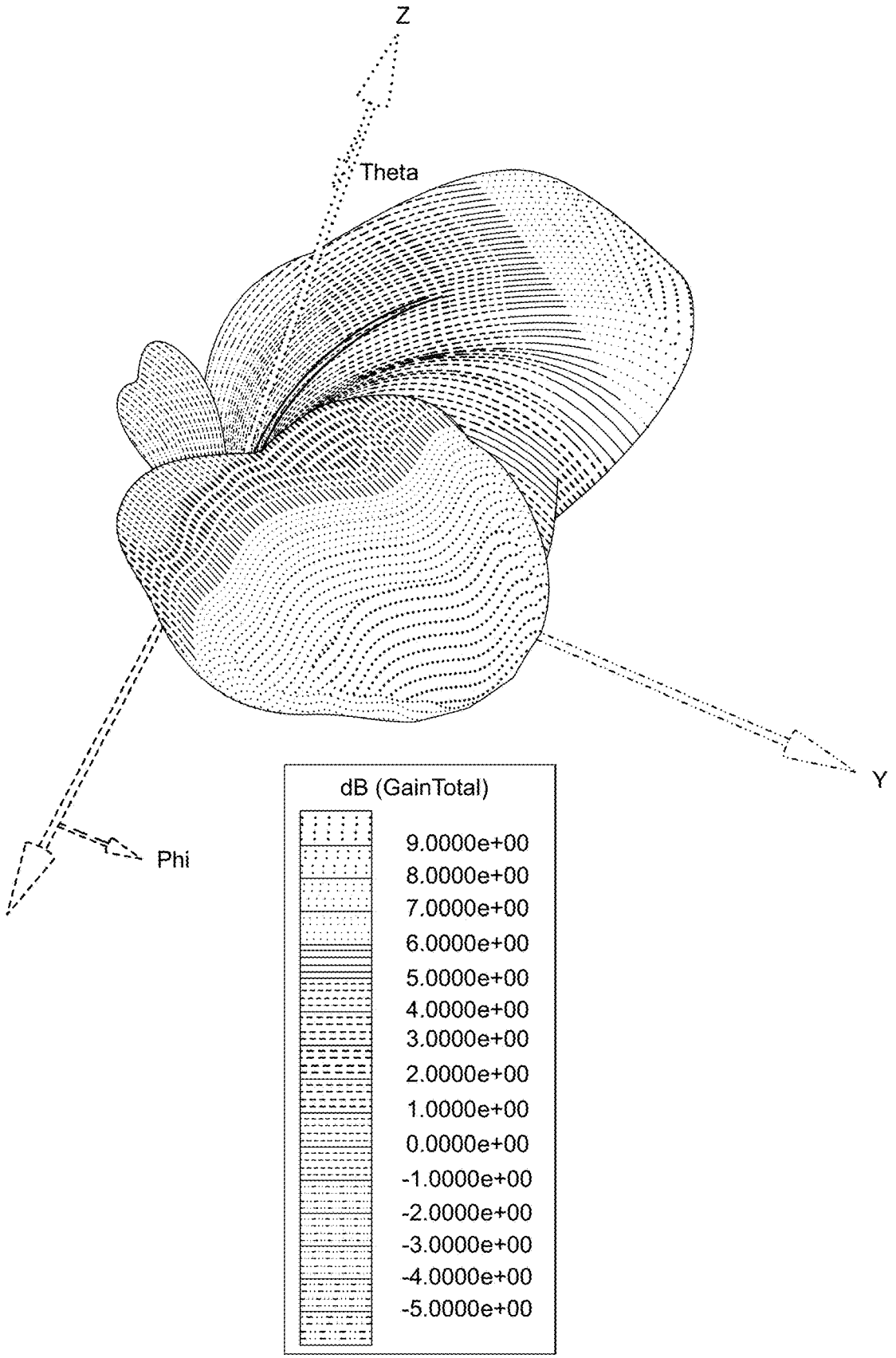
FIG. 6 shows an example of a radiation pattern achievable using the example antenna unit of FIG. 5.
Figure 7:
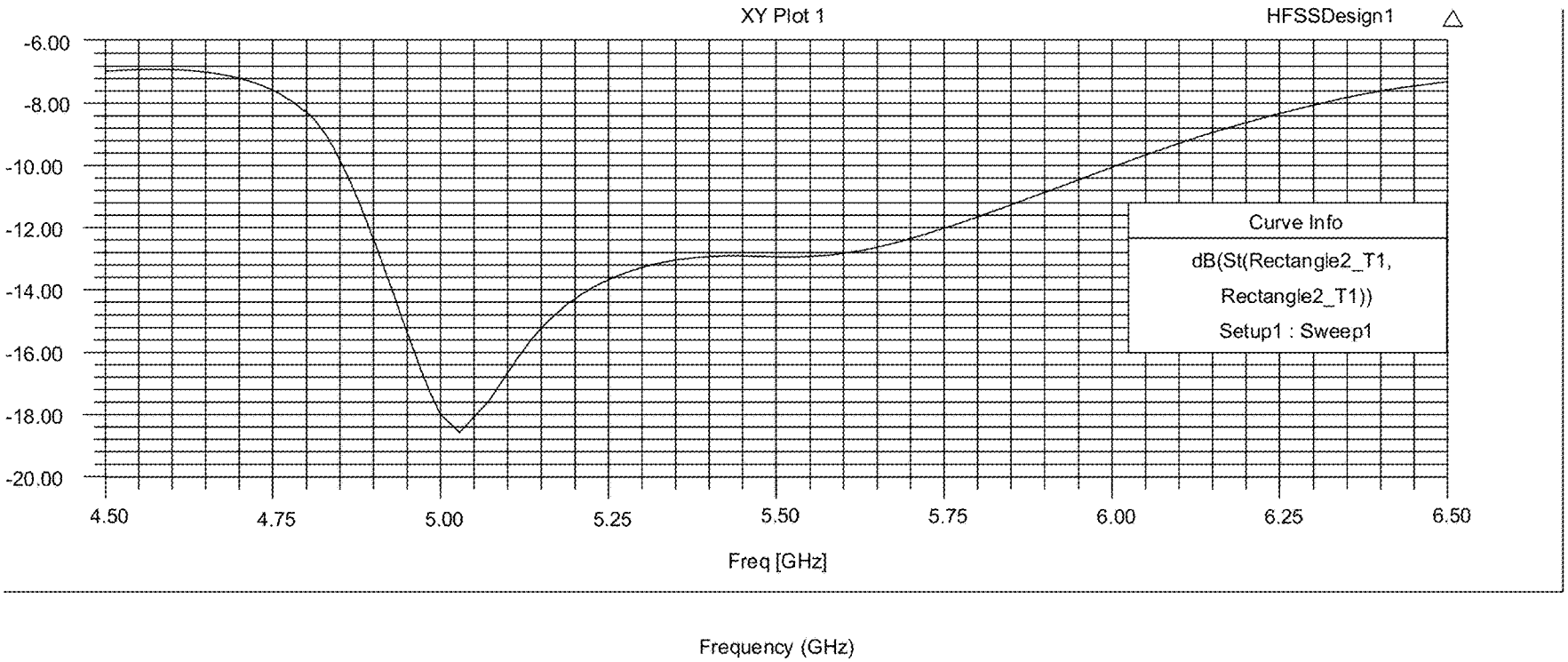
FIG. 7 is a plot of simulation results of input port return loss versus frequency for an example antenna unit according to the present disclosure.

FIG. 6 shows an example radiation pattern that may be achieved using the example antenna unit 100 of FIG. 5. FIG. 7 is a plot of RF port input return loss versus frequency for the antenna unit 100 of FIG. 5. In FIG. 5, the axis of symmetry of the antenna unit 100 is labeled as the z-axis. A first switchable element 116(1) is turned on, enabling a ground connection at the first grounding portion 112(1), and a second switchable element 116(2) is off, disabling grounding at the second grounding portion 112(2).

FIG. 6 shows an example of a simulated directional radiation pattern achievable using the antenna unit 100 of FIG. 5, by grounding only one IFA element 110. FIG. 6 shows the example radiation pattern at 5.5 GHz, for the antenna unit 100 designed for an operating frequency of 5.5 GHz. As shown in FIG. 6, good directionality is achieved, in that the radiation pattern shows a significantly higher gain in the positive y-direction compared to the negative y-direction. This directionality may be switched (to be directed towards the negative y-direction) by turning on the second switchable element 116(2) and turning off the first switchable element 116(1). FIG. 7 is a plot of RF input return loss versus frequency for the antenna unit 100 of FIG. 5.

FIG. 8 shows an example antenna unit 100 in which four IFA elements 110 are each defined by respective grounding portions 112, and conductive arms 114, in which each conductive arm 114 extends from a respective grounding portion 112 towards and beyond a shared common feed portion 106. For each of illustration, FIG. 8 illustrates only first and third IFA elements 110(1), 110(3). However, it will be understood that first and third IFA elements 110(1), 110(3) are representative of how the remaining second and fourth IFA elements are defined in the antenna unit 100.

For example, as shown in FIG. 8, the feed portion 106, the first grounding portion 112(1), and first conductive arm 114(1) together define the first IFA element 110(1). Similarly, the feed portion 106, third grounding portion 112(3), and third conductive arm 114(3), define the third IFA element 110(3). Pairs of the conductive arms 114 may overlap at least partially over a portion of their respective lengths. For example, conductive arms 114(1) and 114(3) overlap with each other over the length of a common portion 113. Similarly, it will be appreciated that second and fourth conductive arms overlap with each other. It should be noted that the first and third conductive arms 114(1), 114(3) cross second and fourth conductive arms, but do not overlap with second and fourth conductive arms.

The four IFA elements 110 in this example are symmetrically arranged about the axis of symmetry (defined by the feed portion 106), and are disposed at 90° relative to each other. However, the IFA elements 110 may be arranged asymmetrically about the axis defined by the feed portion 106. In this example, the antenna unit 100 is orthogonal to the substrate 102 and the grounding plane.

The antenna unit 100 shown in FIG. 8 may be operated in one of several possible switched states. Each switched state is defined by which of the four grounding portions 112(1) to 112(4) is electrically coupled to the grounding plane, and may be set by controlling the on/off states of the switchable elements (not shown in FIG. 8). Accordingly, directionality and shape of the radiation pattern achieved by the antenna unit 100 may be configured by switching on/off different switchable elements, forgoing the need for an RF switch. The omission of an RF switch may lead to improvements in space savings and/or cost savings and may help to reduce overall loss.

Figure 9A:
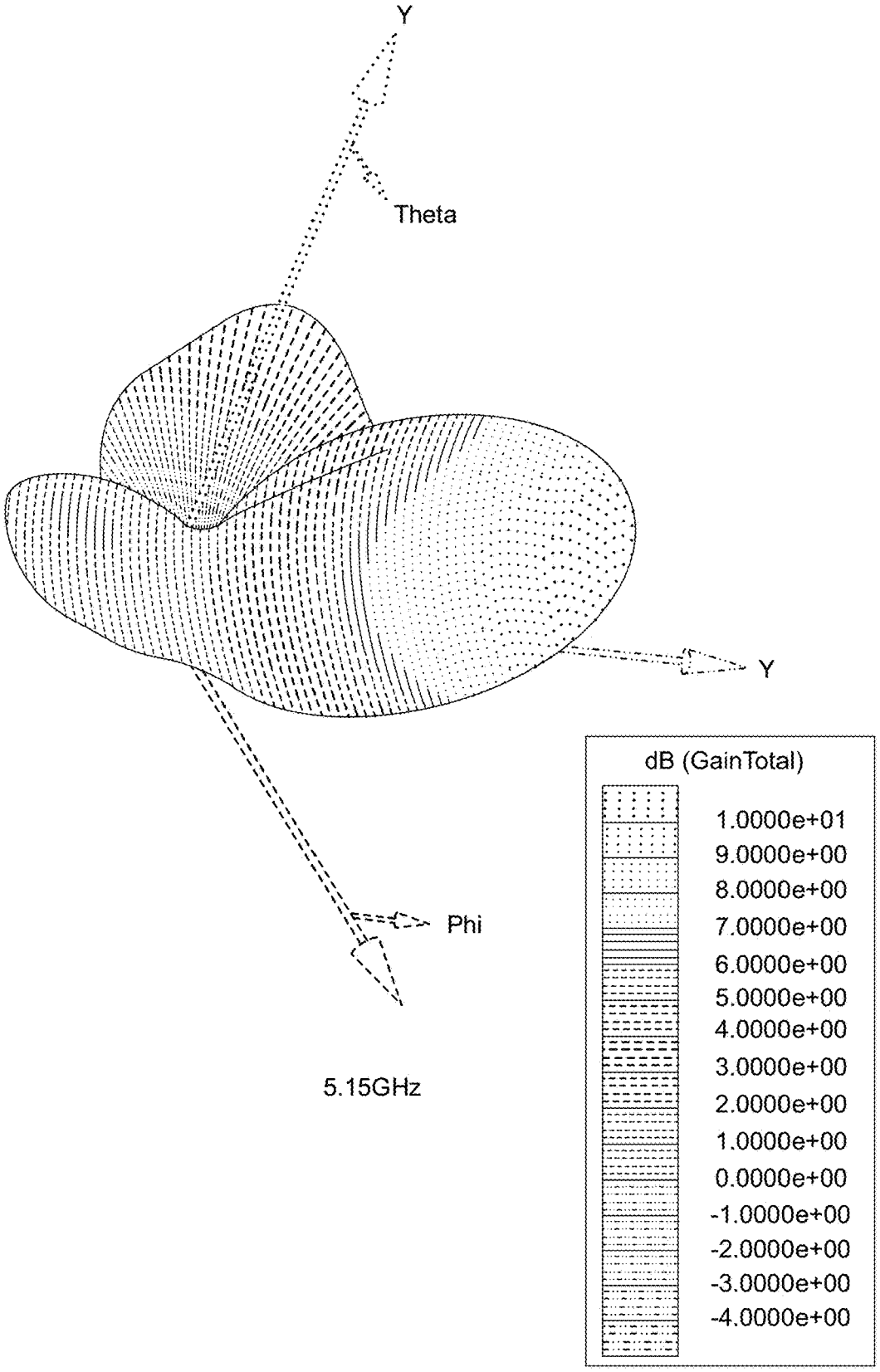
FIGS. 9A, 9B and 9C show example radiation patterns achievable using the example antenna unit of FIG. 8 in a first switched state.
Figure 9B:
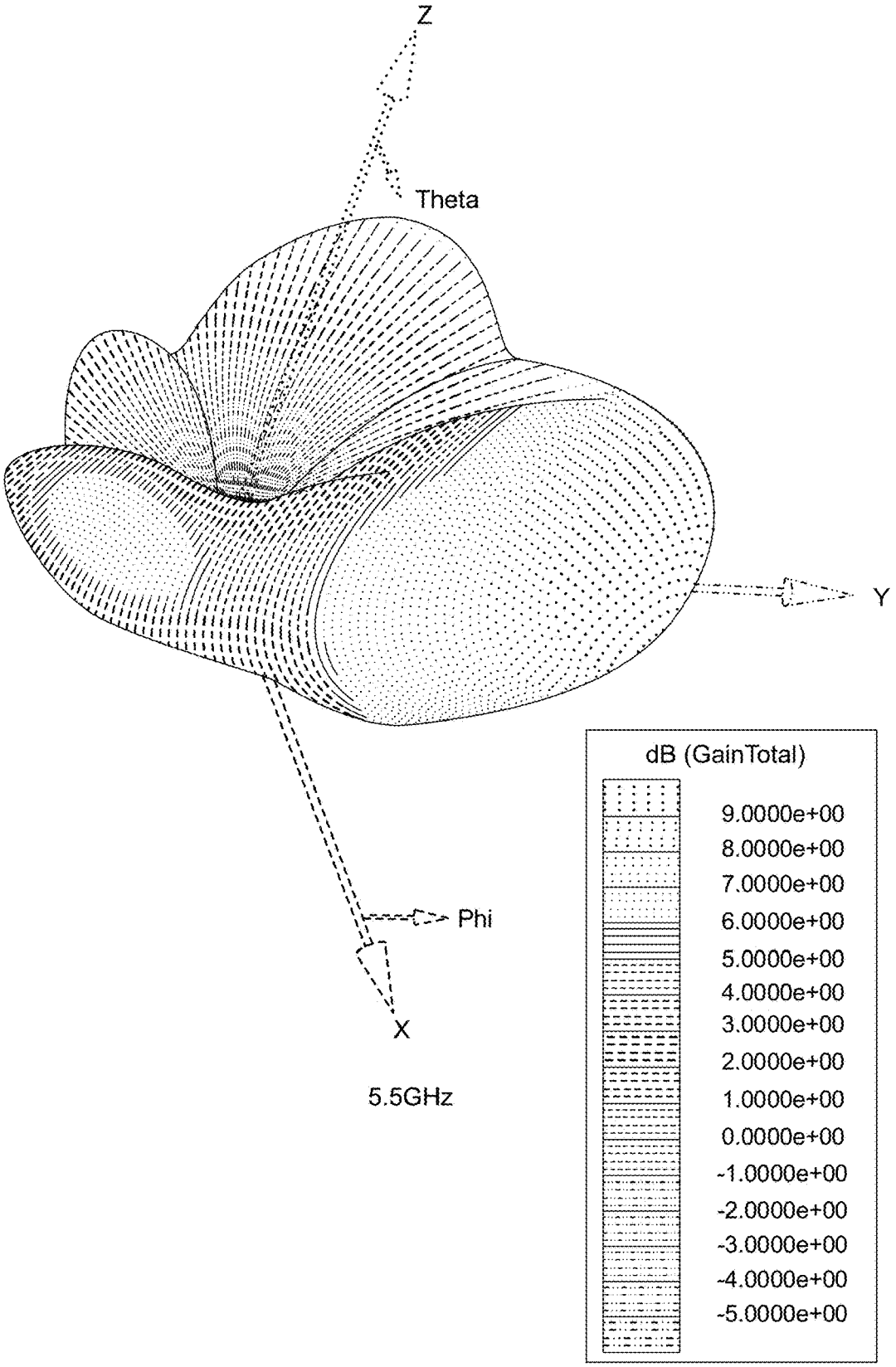
Figure 9C:
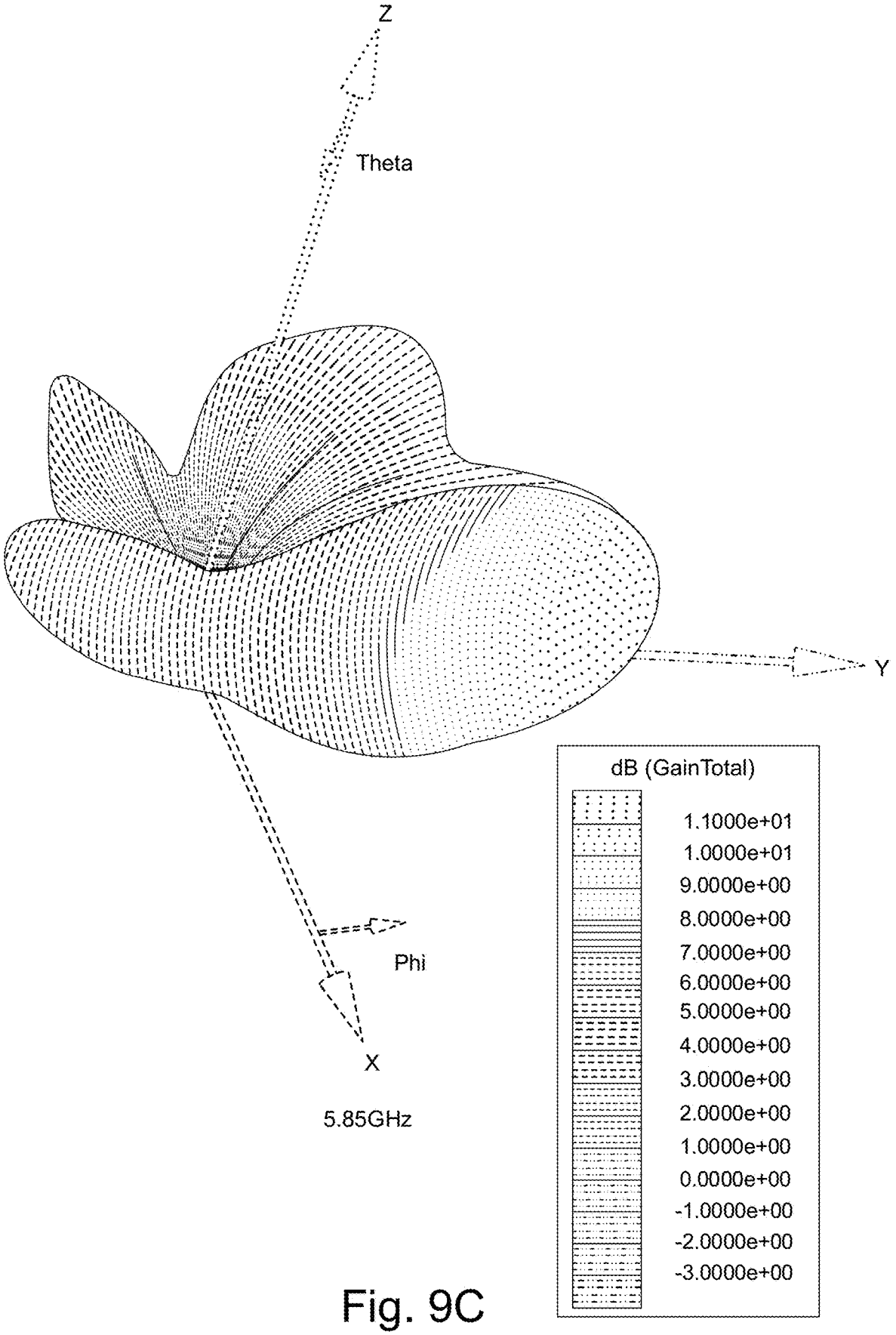
Figure 10:
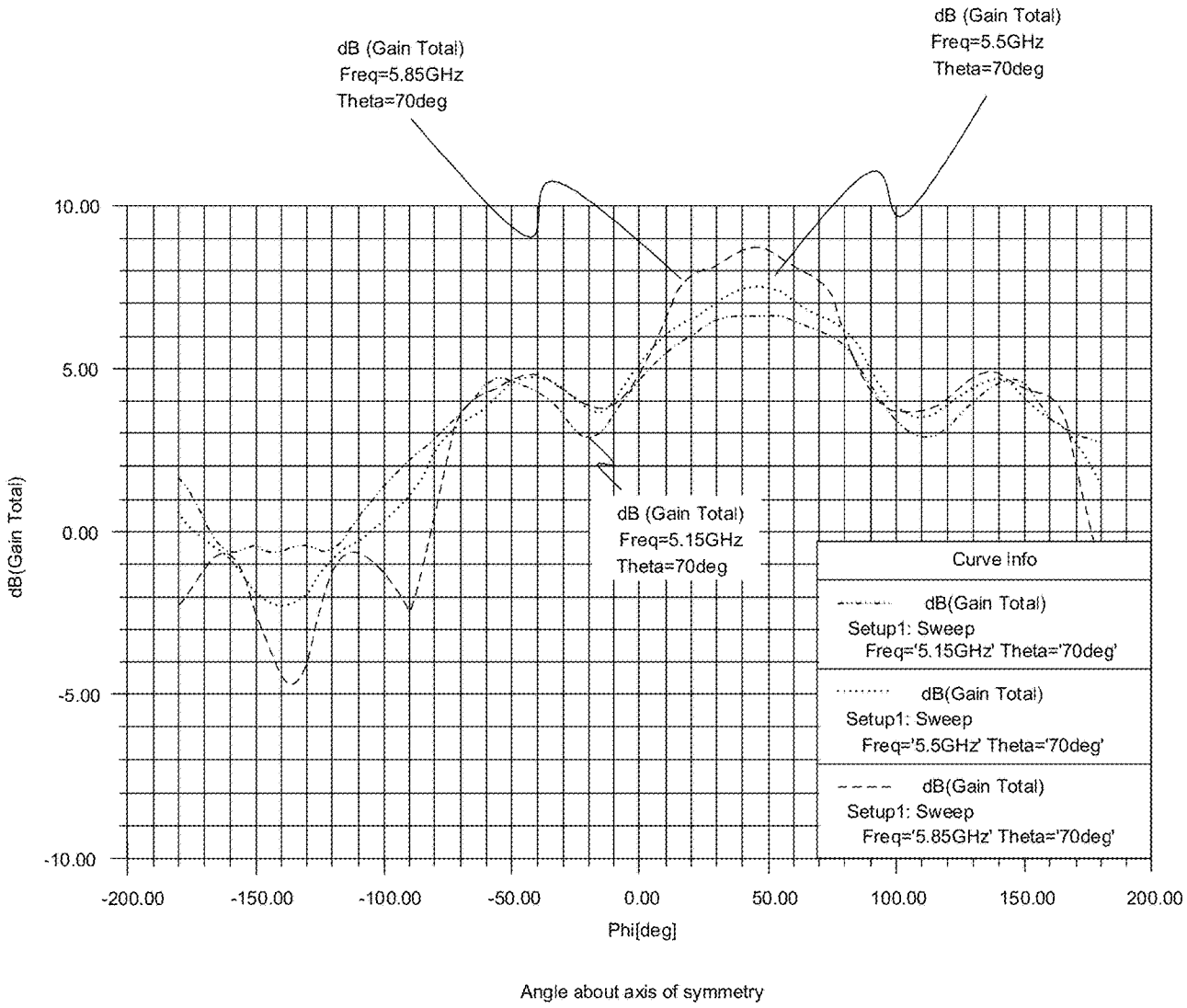
FIG. 10 is a plot of simulation results of radiated gain versus angle, at different frequencies, for the example antenna unit of FIG. 8 in the first switched state.
Figure 11:
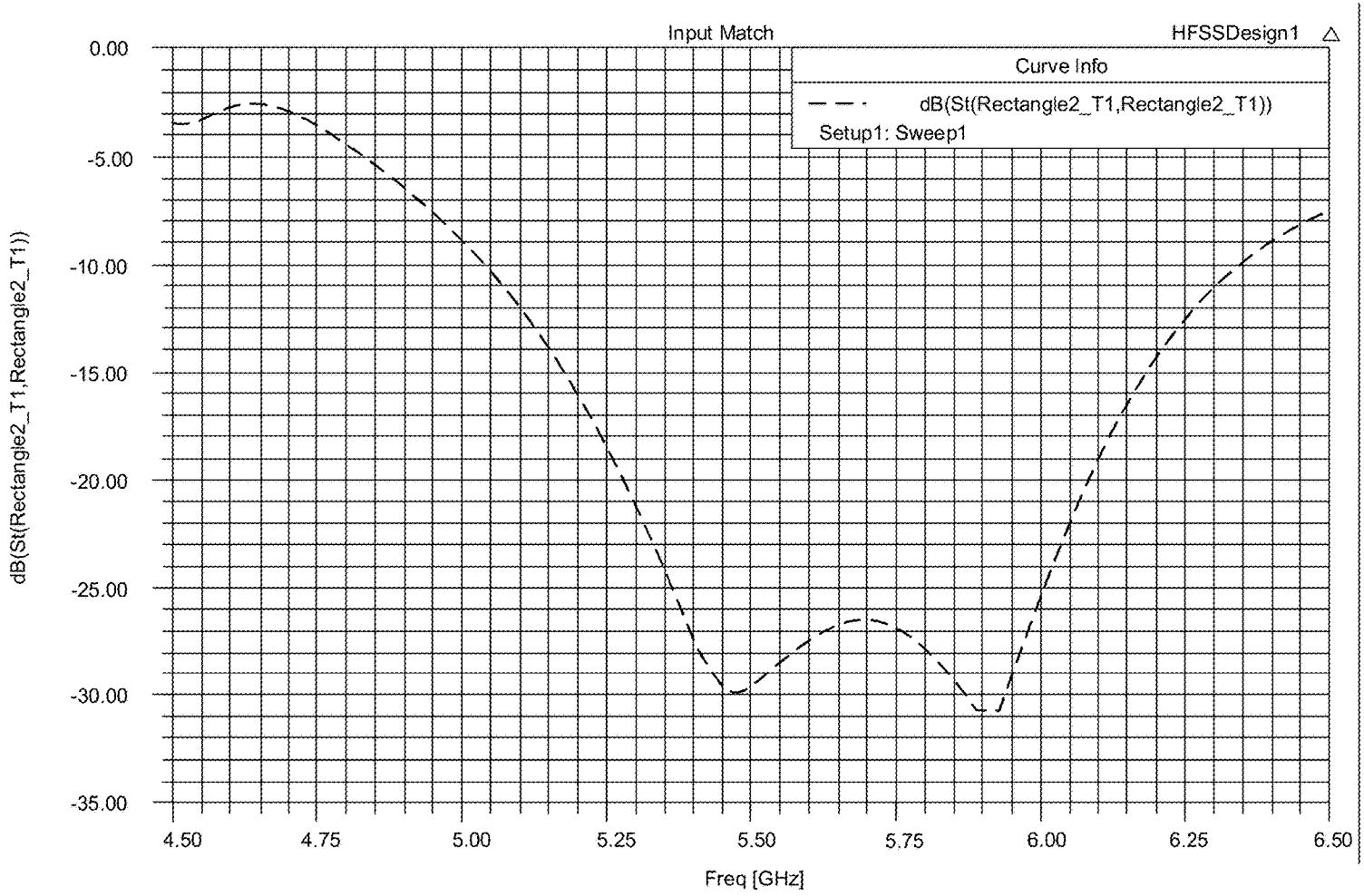
FIG. 11 is a plot of simulation results of port input return loss versus frequency for the example antenna unit of FIG. 8 in a first switched state.

FIGS. 9A, 9B and 9C show example simulated radiation patterns when the antenna unit 100 of FIG. 8 is operated in a first switched state. In this example first switched state, the first and second grounding portions 112(1), 112(2) are electrically coupled to the grounding plane, and the third and fourth grounding portions 112(3), 112(4) are not electrically coupled to the grounding plane. FIGS. 9A, 9B and 9C show the radiation pattern at three different frequencies, namely 5.15 GHz, 5.5 GHz and 5.85 GHz, for the antenna unit 100 of FIG. 8 when designed for an operating frequency of 5.5 GHz. FIG. 10 shows simulation results of gain (dB) versus angle (about the axis of symmetry), at frequencies of 5.15 GHz, 5.5 GHz and 5.85 GHz, for the antenna unit 100 of FIG. 8 in the first switched state. FIG. 11 is a plot of RF input port return loss versus frequency for the antenna unit 100 of FIG. 8 in the first switched state.

Figure 12A:
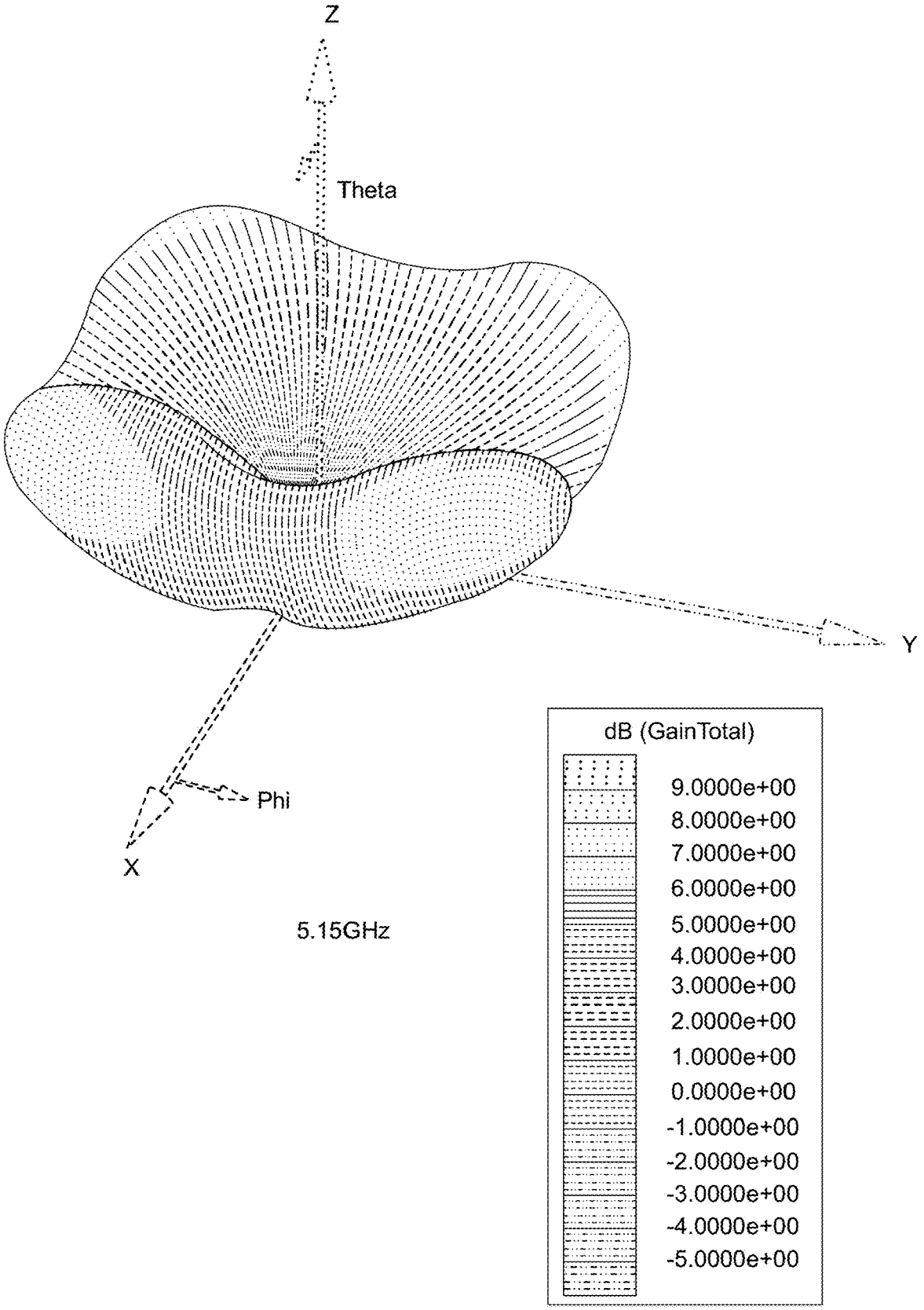
FIGS. 12A, 12B and 12C show example radiation patterns achievable using the example antenna unit of FIG. 8 in a second switched state.
Figure 12B:
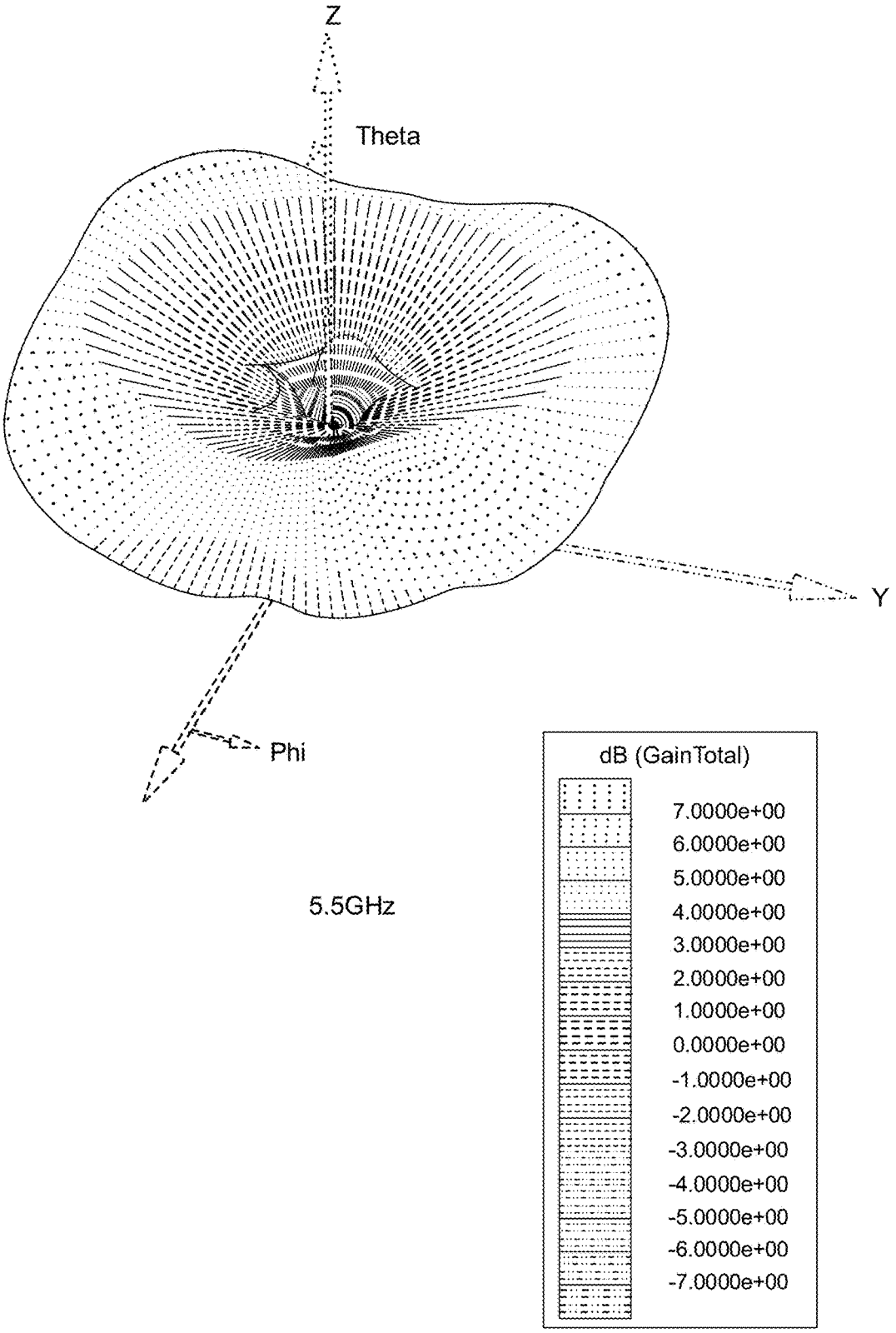
Figure 12C:
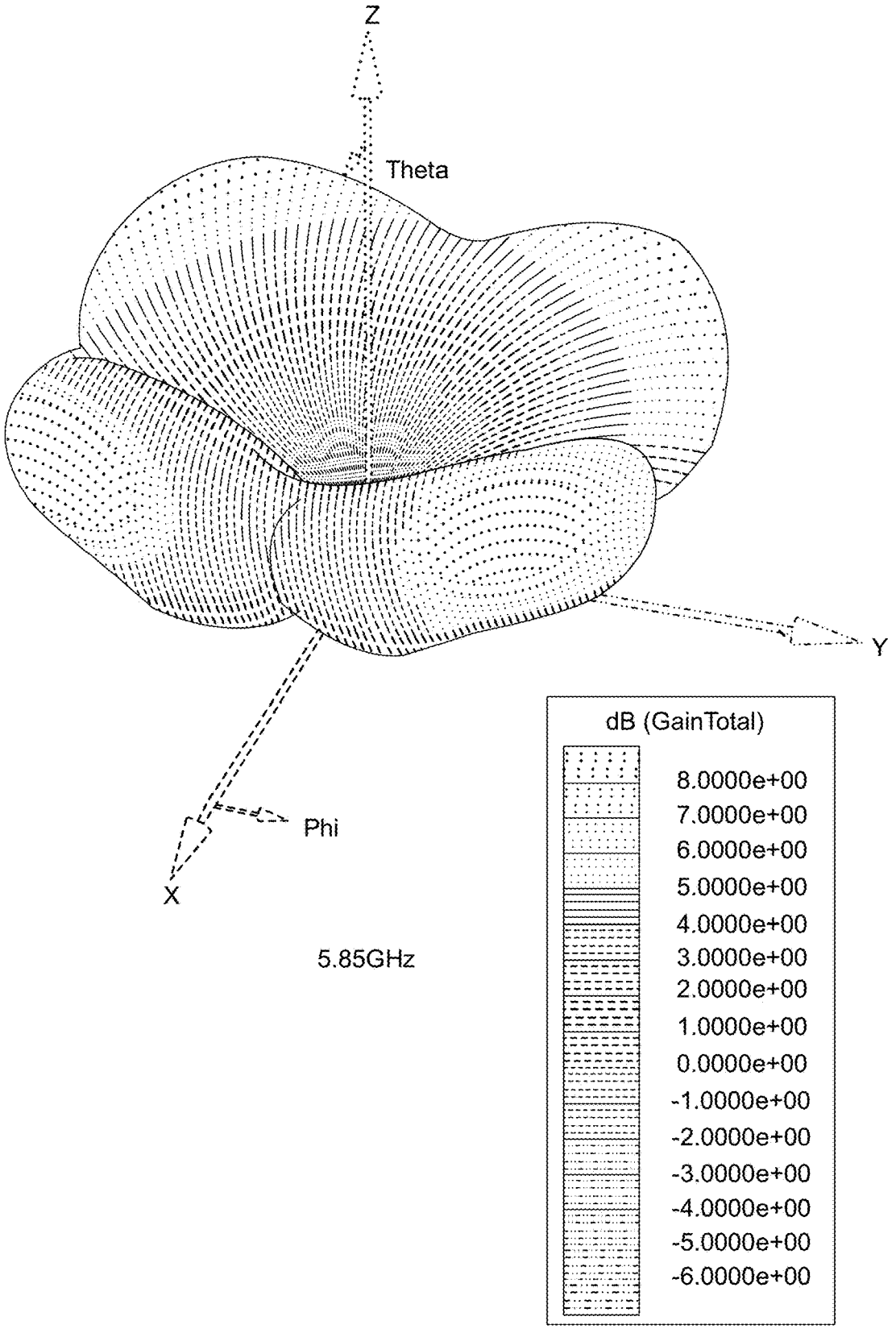
Figure 13:
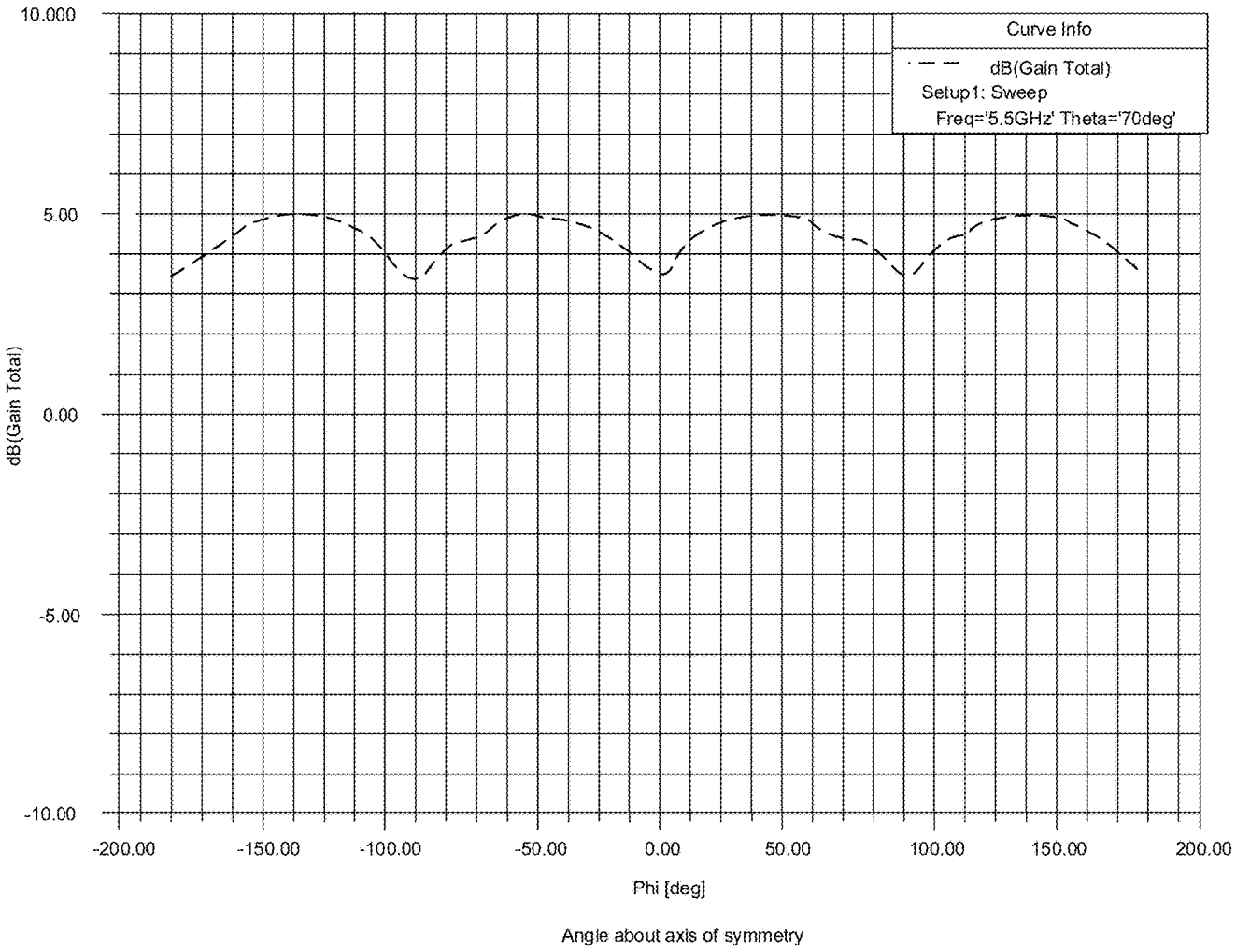
FIG. 13 is a plot of simulation results of radiated gain versus angle for the example antenna unit of FIG. 8 in the second switched state.
Figure 14:
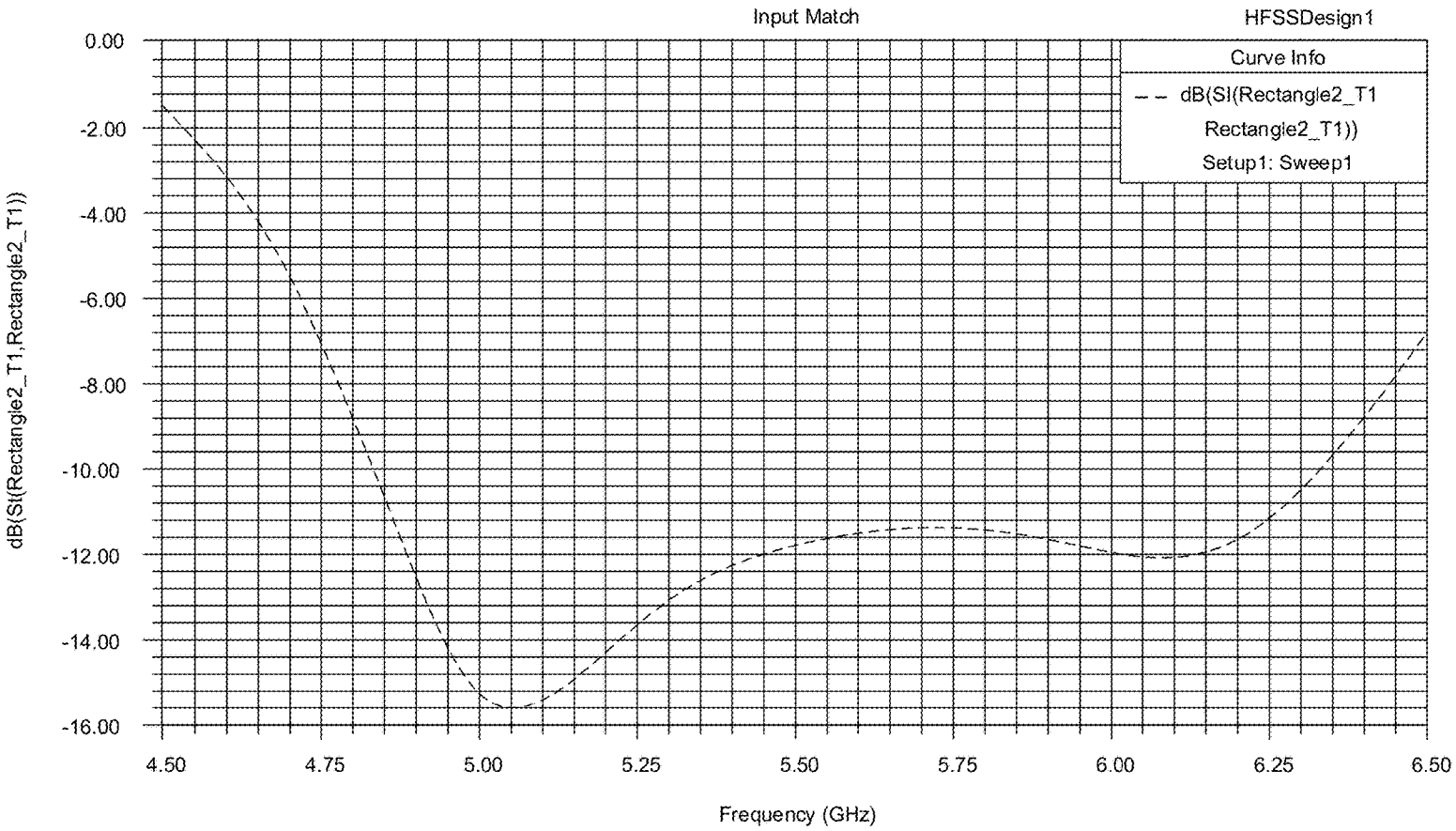
FIG. 14 is a plot of simulation results of port input return loss versus frequency for the example antenna unit of FIG. 8 in the second switched state.

FIGS. 12A, 12B and 12C show example simulated radiation patterns when the antenna unit 100 of FIG. 8 is operated in a second switched state. In this example second switched state, all grounding portions 112(1) to 112(4) are not electrically coupled to the grounding plane. FIGS. 12A, 12B and 12C show the radiation pattern at three different frequencies, namely 5.15 GHz, 5.5 GHz and 5.85 GHz, for the antenna unit 100 of FIG. 8 when designed for an operating frequency of 5.5 GHz. FIG. 13 shows simulation results of gain (dB) versus angle (about the axis of symmetry), at the operating frequency of 5.5 GHz, for the antenna unit 100 of FIG. 8 in the second switched state. FIG. 14 is a plot of RF input port return loss vs. frequency for the antenna unit 100 of FIG. 8 in the second switched state. As seen in FIGS. 11 and 14, the input return loss of the RF signal port 104 is similar to that of a 50 Ohm impedance.

Generally, the disclosed antenna unit 100 may include any number of IFA elements 110 at different rotation angles. For example, three IFA elements 110 may be arranged symmetrically with a relative rotation of 120° angle between adjacent IFA elements 110, or asymmetrically at unequal angles between adjacent IFA elements 110. The three IFA elements 110 may be defined by the common feed portion 106, three respective selective grounding portions 112 and three respective conductive arms 114. The three conductive arms 114 may cross each other, without overlapping for any significant length.

Compared to conventional antenna units with discrete IFA antennas and/or having a RF switch, the disclosed antenna unit may require less space, enable higher density of IFA elements, and may have lower overall complexity. The disclosed antenna unit may have enhanced suitability for implementation in wireless communication devices, such as UE or AP devices, particularly where space is limited. In addition, using PIN diodes as switchable elements, in place of RF switches, may result in improved linearity, higher gain, and/or lower loss. PIN diodes are also relatively inexpensive and fast components.

The disclosed antenna unit may be useful for achieving higher density of antenna elements, including for lower operating frequencies. The disclosed antenna unit may be implemented in-plane or orthogonal to the substrate.

The disclosed antenna unit may be implemented in various applications that use antennas, such as telecommunication applications (e.g., transceiver applications in UEs or APs). An example of the disclosed antenna unit may be incorporated into a low profile WLAN AP. The dimensions described in this application for the various elements of the antenna unit are non-exhaustive examples and many different dimensions can be applied depending on both the intended operating frequency bands and physical packaging constraints.

The present disclosure may be embodied in other specific forms without departing from the subject matter of the claims. The described example embodiments are to be considered in all respects as being only illustrative and not restrictive. Various modifications and combinations of the illustrative embodiments, as well as other embodiments of the invention, will be apparent to persons skilled in the art upon reference to the description. Selected features from one or more of the above-described embodiments may be combined to create alternative embodiments not explicitly described, features suitable for such combinations being understood within the scope of this disclosure.

All values and sub-ranges within disclosed ranges are also disclosed. Also, although the systems, devices and processes disclosed and shown herein may comprise a specific number of elements/components, the systems, devices and assemblies could be modified to include additional or fewer of such elements/components. For example, although any of the elements/components disclosed may be referenced as being singular, the embodiments disclosed herein could be modified to include a plurality of such elements/components. The subject matter described herein intends to cover and embrace all suitable changes in technology. It is therefore intended that the appended claims encompass any such modifications or embodiments.

The invention claimed is:

1. A radio frequency (RF) antenna unit comprising:

a feed portion for electrically coupling the RF antenna unit to an RF signal port;

at least a first selective grounding portion and a second selective grounding portion, each selective grounding portion being configured to selectively enable or disable an electrical coupling to a substrate;

a first conductive arm providing electrical conduction between the feed portion and the first selective grounding portion, extending from the first selective grounding portion towards the feed portion and extending beyond the feed portion; and at least a second conductive arm providing electrical conduction between the feed portion and the second selective grounding portion, extending from the second selective grounding portion towards the feed portion and extending beyond the feed portion;

the feed portion, the first selective grounding portion and the first conductive arm together defining a first inverted F antenna (IFA) element of the RF antenna unit;

the feed portion, the second selective grounding portion and the second conductive arm together defining at least a second IFA element of the RF antenna unit;

the feed portion being common to both the first and at least the second IFA elements.

2. The RF antenna unit of claim 1 wherein the first conductive arm and the at least second conductive arm partially overlap with each other, the overlap being a conductive portion of the RF antenna unit that is common to the first and second conductive arms.

3. The RF antenna unit of claim 2 wherein there are two IFA elements defined by: the feed portion, two respective selective grounding portions and two respective conductive arms;

the two IFA elements being arranged with respective conductive arms extending opposite to and partially overlapping with each other.

4. The RF antenna unit of claim 2 wherein there are four IFA elements defined by: the feed portion, four respective selective grounding portions and four respective conductive arms;

the four IFA elements being arranged about the axis of symmetry with a relative rotation of 90° between adjacent IFA elements; and the four IFA elements include first and second pairs of IFA elements, each pair of IFA elements having conductive arms extending opposite to and partially overlapping with each other.

5. The RF antenna unit of claim 1 wherein there are three IFA elements defined by: the feed portion, three respective selective grounding portions and three respective conductive arms;

the three IFA elements being arranged about the axis of symmetry with a relative rotation of 120° between adjacent IFA elements; and the three conductive arms cross each other.

6. The RF antenna unit of claim 1 wherein the first IFA element and the at least second IFA element are arranged symmetrically relative to each other about an axis of symmetry defined by the feed portion.

7. The RF antenna unit of claim 1 wherein each selective grounding portion is selectively coupled to a ground plane of the substrate through a switchable element.

8. The RF antenna unit of claim 7 wherein the switchable element comprises a PIN diode.

9. The RF antenna unit of claim 7 wherein the switchable element is configured to receive a control signal to control the switchable element to enable or disable the electrical coupling to the substrate.

10. The RF antenna unit of claim 1 wherein each IFA element has substantially equal dimensions.

11. The RF antenna unit of claim 1 wherein each IFA element has substantially same antenna characteristics.

12. The RF antenna unit of claim 1 wherein at least one IFA element has dimensions different from at least another IFA element, and wherein the feed portion is common to all IFA elements.

13. An apparatus for wireless communications comprising:

a substrate including a ground plane;

a radio frequency (RF) signal port; and a RF antenna unit including:

a feed portion for electrically coupling the RF antenna unit to the RF signal port, the feed portion defining an axis of symmetry of the RF antenna unit;

at least a first selective grounding portion and a second selective grounding portion, each selective grounding portion being configured to selectively enable or disable an electrical coupling to the ground plane via the substrate;

a first conductive arm providing electrical conduction between the feed portion and the first selective grounding portion, extending from the first selective grounding portion towards the feed portion and extending beyond the feed portion; and at least a second conductive arm providing electrical conduction between the feed portion and the second selective grounding portion, extending from the second selective grounding portion towards the feed portion and extending beyond the feed portion;

the feed portion, the first selective grounding portion and the first conductive arm together defining a first inverted F antenna (IFA) element of the RF antenna unit;

the feed portion, the second selective grounding portion and the second conductive arm together defining at least a second IFA element of the RF antenna unit;

the feed portion being common to both the first and at least the second IFA elements, the first IFA element and at least the second IFA element being arranged symmetrically relative to each other about the axis of symmetry.

14. The apparatus of claim 13 wherein the first conductive arm and the at least second conductive arm partially overlap with each other, the overlap being a conductive portion of the RF antenna unit common to the first and second conductive arms.

15. The apparatus of claim 14 wherein the RF antenna unit has two IFA elements defined by the feed portion, two respective selective grounding portions and two respective conductive arms, the two IFA elements being arranged with respective conductive arms extending opposite to and partially overlapping with each other.

16. The apparatus of claim 14 wherein the RF antenna unit has four IFA elements defined by the feed portion, four respective selective grounding portions and four respective conductive arms, the four IFA elements being arranged about the axis of symmetry with a relative rotation of 90° between adjacent IFA elements, and the four IFA elements include first and second pairs of IFA elements, each pair of IFA elements having conductive arms extending opposite to and partially overlapping with each other.

17. The apparatus of claim 13 wherein the RF antenna unit has three IFA elements defined by: the feed portion, three respective selective grounding portions and three respective conductive arms, the three IFA elements being arranged about the axis of symmetry with a relative rotation of 120° between adjacent IFA elements, and the three IFA elements being arranged with the three conductive arms crossing each other.

18. The apparatus of claim 13 wherein at least one IFA element of the RF antenna unit is defined in a plane of the substrate.

19. The apparatus of claim 13 wherein the feed portion and the selective grounding portions of the RF antenna unit are substantially perpendicular to the substrate.

20. The apparatus of claim 13 wherein at least one IFA element of the RF antenna unit is defined in a plane orthogonal to a plane of the substrate.

21. The apparatus of claim 13 wherein each selective grounding portion of the RF antenna unit is selectively coupled to the ground plane through a switchable element.

22. The apparatus of claim 21 wherein the switchable element comprises a PIN diode.

23. The apparatus of claim 13 wherein each conductive arm of the RF antenna unit has substantially equal length.

24. The apparatus of claim 13 wherein each IFA element of the RF antenna unit has substantially same antenna characteristics.

* * * * *